US010314377B2

(12) United States Patent
Stephens

(10) Patent No.: US 10,314,377 B2
(45) Date of Patent: Jun. 11, 2019

(54) LUNCH BOX WITH WORKING SURFACE

(71) Applicant: Rick Stephens, Chicago, IL (US)

(72) Inventor: Rick Stephens, Chicago, IL (US)

(73) Assignee: CALIFORNIA INNOVATIONS INC. (CA)

( * ) Notice: Subject to any disclaimer, the term of this patent is extended or adjusted under 35 U.S.C. 154(b) by 455 days.

(21) Appl. No.: 14/732,181

(22) Filed: Jun. 5, 2015

(65) Prior Publication Data

US 2016/0355319 A1 Dec. 8, 2016

(51) Int. Cl.

| | |
|---|---|
| ***A45C 13/26*** | (2006.01) |
| ***A45C 11/20*** | (2006.01) |
| ***A45C 13/00*** | (2006.01) |
| ***A45C 13/02*** | (2006.01) |
| ***A45C 13/12*** | (2006.01) |
| *A45C 7/00* | (2006.01) |

(52) U.S. Cl.

CPC ..... *A45C 13/26* (2013.01); *A45C 11/20* (2013.01); *A45C 13/005* (2013.01); *A45C 13/02* (2013.01); *A45C 13/126* (2013.01); *A45C 2007/0004* (2013.01); *A45C 2013/026* (2013.01)

(58) Field of Classification Search

USPC ..... 220/592.01, 592.03, 592, 810, 847, 220/DIG. 10; 206/541, 810

See application file for complete search history.

(56) References Cited

U.S. PATENT DOCUMENTS

| | | | |
|---|---|---|---|
| 3,459,359 | A | 8/1969 | Heffernan |
| 4,889,257 | A | 12/1989 | Steffes |
| D328,550 | S | 8/1992 | Mogil |
| D340,387 | S | 10/1993 | Melk |
| D340,621 | S | 10/1993 | Melk |
| D340,840 | S | 11/1993 | Melk |
| 5,354,131 | A | 10/1994 | Mogil |
| 5,403,095 | A | 4/1995 | Melk |
| D368,387 | S | 4/1996 | Bureau |
| D371,052 | S | 6/1996 | Melk |
| D373,514 | S | 9/1996 | Melk |
| D382,771 | S | 8/1997 | Mogil |
| D382,772 | S | 8/1997 | Mogil |
| D387,249 | S | 12/1997 | Mogil |
| D391,121 | S | 2/1998 | Melk |
| D394,552 | S | 5/1998 | Melk |
| 5,915,580 | A | 6/1999 | Melk |
| 5,924,303 | A | 6/1999 | Hodosh |

(Continued)

*Primary Examiner* — James N Smalley
*Assistant Examiner* — Madison L Poos
(74) *Attorney, Agent, or Firm* — Ostrolenk Faber LLP

(57) ABSTRACT

A soft-sided insulated container assembly has a generally box-shaped form like a school lunch box, having a main body and a lid. The lid is formed of one of the largest panels of the box-structure, and is joined to the main body of the box by a hinge that lets the lid lie flat next to the main body when the box is open. The inside face of the lid then defines a work surface on which to place objects such as foodstuffs and beverages. The work surface may be formed in a substantially rigid molded stiffener member, and may be divided into sub-regions with raised retainers to discourage sliding of objects where not precisely level. The container assembly may include a rigid internal liner with which the lid may mate zipperlessly. The mating portion of the lid may be formed in the same rigid member as the work surface.

19 Claims, 15 Drawing Sheets

(56) References Cited

U.S. PATENT DOCUMENTS

| | | | | |
|---|---|---|---|---|
| 5,950,834 | A * | 9/1999 | Woodnorth | A45C 11/20 206/541 |
| D419,770 | S | 2/2000 | Mogil | |
| D421,366 | S | 3/2000 | Mogil | |
| 6,067,816 | A | 5/2000 | Hodosh | |
| 6,068,402 | A | 5/2000 | Freese | |
| 6,073,796 | A | 6/2000 | Mogil | |
| 6,092,661 | A | 7/2000 | Mogil | |
| 6,116,045 | A | 9/2000 | Mogil | |
| D435,968 | S | 1/2001 | Mogil | |
| D436,342 | S | 1/2001 | Lopez | |
| D436,442 | S | 1/2001 | Mogil | |
| 6,234,677 | B1 | 5/2001 | Mogil | |
| 6,237,776 | B1 | 5/2001 | Mogil | |
| 6,238,091 | B1 | 5/2001 | Mogil | |
| 6,247,328 | B1 | 6/2001 | Mogil | |
| D446,937 | S | 8/2001 | Mogil | |
| D452,075 | S | 12/2001 | Mogil | |
| D453,625 | S | 2/2002 | Mogil | |
| 6,363,739 | B1 | 4/2002 | Mogil | |
| 6,439,389 | B1 | 8/2002 | Mogil | |
| 6,481,239 | B2 | 11/2002 | Mogil | |
| 6,513,661 | B1 | 2/2003 | Mogil | |
| 6,582,124 | B2 | 6/2003 | Mogil | |
| 6,644,063 | B2 | 11/2003 | Mogil | |
| 6,821,019 | B2 | 11/2004 | Mogil | |
| 7,162,890 | B2 | 1/2007 | Mogil | |
| 7,597,478 | B2 | 10/2009 | Pruchnicki | |
| 7,669,436 | B2 | 3/2010 | Mogil | |
| 7,682,080 | B2 | 3/2010 | Mogil | |
| 7,757,878 | B2 | 7/2010 | Mogil | |
| D620,707 | S | 8/2010 | Mogil | |
| D627,199 | S | 11/2010 | Pruchnicki | |
| 7,841,207 | B2 | 11/2010 | Mogil | |
| D635,828 | S | 4/2011 | Pruchnicki | |
| 7,988,006 | B2 | 8/2011 | Mogil | |
| 8,043,004 | B2 | 10/2011 | Mogil | |
| 8,061,159 | B2 | 11/2011 | Mogil | |
| 8,096,442 | B2 | 1/2012 | Ramundi | |
| 8,191,747 | B2 | 6/2012 | Pruchnicki | |
| 8,348,510 | B2 | 1/2013 | Mogil | |
| 8,459,058 | B2 | 6/2013 | Mogil | |
| 8,640,937 | B2 | 2/2014 | Pruchnicki | |
| 8,646,970 | B2 | 2/2014 | Mogil | |
| 8,777,045 | B2 | 7/2014 | Mitchell | |
| 8,857,654 | B2 | 10/2014 | Mogil | |
| 8,899,071 | B2 | 12/2014 | Mogil | |
| 9,408,445 | B2 | 8/2016 | Mogil | |
| 9,422,099 | B2 | 8/2016 | Mitchell | |
| 2001/0010312 | A1 | 8/2001 | Mogil | |
| 2001/0039807 | A1 | 11/2001 | Mogil | |
| 2002/0043076 | A1 | 4/2002 | Hodosh | |
| 2002/0126920 | A1 | 9/2002 | Mogil | |
| 2003/0198408 | A1 | 10/2003 | Mogil | |
| 2004/0035143 | A1 | 2/2004 | Mogil | |
| 2004/0136621 | A1 | 7/2004 | Mogil | |
| 2005/0072181 | A1 | 4/2005 | Mogil | |
| 2005/0103044 | A1* | 5/2005 | Mogil | A45C 11/20 62/457.7 |
| 2005/0117817 | A1 | 6/2005 | Mogil | |
| 2005/0205459 | A1 | 9/2005 | Mogil | |
| 2007/0237432 | A1 | 10/2007 | Mogil | |
| 2008/0245096 | A1* | 10/2008 | Hanson | A45C 11/20 62/457.2 |
| 2010/0116830 | A1 | 5/2010 | Mogil | |
| 2010/0282763 | A1 | 11/2010 | Mogil | |
| 2011/0127274 | A1 | 6/2011 | Mogil | |
| 2013/0341338 | A1* | 12/2013 | Mitchell | A45C 11/20 220/592.2 |
| 2014/0345314 | A1* | 11/2014 | Cox | A45F 3/46 62/440 |
| 2015/0296940 | A1* | 10/2015 | Tseng | A45C 5/14 190/114 |

* cited by examiner

LUNCH BOX WITH WORKING SURFACE

FIELD OF THE INVENTION

This invention relates to the field of insulated portable containers.

BACKGROUND OF THE INVENTION

Soft-sided insulated containers may be used to transport articles that may best be served cool, such as beverages or salads, or warm, such as appetizers, hot dogs, and so on. Such containers are also used to carry liquids, whether hot liquids, such as soup containers, coffee or tea, or cold liquids such as beer, soft drinks, or other carbonated beverages, juices and milk. The containers are typically made in a generally cube-like shape, whether of sides are of equal length or not, having a base, four upstanding walls, and a top. The top wall is often a lid which opens to permit articles to be placed in, or retrieved from, the container.

In soft-sided insulated containers heretofore, the main closure of the lid has tended to depend on the closing of a zipper, often a zipper running around three sides of a rectangle, with the fourth side being hinged. The lid may rest on a foam lip or bead. When a container of this nature falls over, its resistance to the spilling of liquid through the closure may not be as effective as might be desired. It might be advantageous to have a somewhat tighter seal, such as might be made by stiffer materials in an interference fit. A soft-sided panel would not normally be sufficiently stiff to achieve such a seal. The use of a seal in this nature might also permit the elimination of the main peripheral zipper of the main closure of the container.

Soft-sided insulated containers can also be used as lunch containers or lunch boxes. Such containers may be used by school children to transport their lunch or snacks or other objects to school, to camp, or on field trips. When an object is removed from the container, it may be that it would be convenient to have some place to rest that object. For instance, parents may be concerned about the cleanliness of school lunchrooms and not want their children's food to come into contact with unclean surfaces or surfaces touched by other children. It may also be that one wishes to have a clean surface for placing a piece of fruit or a sandwich, or a surface for cutting a lime or lemon. For whatever reason, it may be desirable to have a place for resting objects. It may also be convenient for that resting place to be firm, such that objects placed upon it may be less prone to wobble or tip, and for that resting place to be washable such that it may be wiped clean with a cloth should drinks or other objects be spilled on it. Further still, it may be convenient for that resting place to be such as may discourage, or limit, the extent to which objects may slide if the surface is not precisely level, as may be the case at a picnic, at a sporting venue, at the beach, or in a moving vehicle such as a school bus.

Furthermore, children are sometimes inattentive with their belongings. It may be desirable to limit the number of items they have to remember to transport to and from school. Providing a working surface on which to place objects that is secured to their lunch container may prevent loss or misplacement of the working surface.

SUMMARY OF THE INVENTION

In an aspect of the invention there is a soft-sided insulated box-shaped lunch container having an attached lid movable to an open position lying flat next thereto.

In a feature of that aspect of the invention, the lid has an inside surface that faces upward when the lid is in the open position. The inside surface is formed to define a work surface having an object retainer. In an additional feature, the lid includes a stiffened member. The stiffened member is formed to define the work surface. In another additional feature, the object retainer includes a raised relief feature formed in the stiffened member. In another feature, the lid includes a stiffened member, the stiffened member is formed to define a work surface and a raised retaining rim of the work surface, the upwardly facing inside surface of the lid including the work surface. In a further additional feature, the stiffened member has a plurality of sub-regions of the stiffened member having raised retainers.

In another feature, the container has a length and a width, and a through thickness. The through thickness is less than each of the length and the width. The container has a main body having a base and an upstanding peripheral side wall. The main body has a peripheral margin to which the lid mates in a closed position. In the open position the lid lies at a level shy of the margin. In a further feature, in the open position the lid lies adjacent to the base. In another feature, the container has a body, the lid is secured to the body by a flexible securement. In another feature, the flexible securement is a flexible hinge running along a margin of the lid. In still another feature, the container has a depth dimension, and the hinge has a reach equal to at least half of the depth. In still another feature, the hinge has a reach corresponding to the depth, and the hinge includes a web member having a first margin joined to the lid and a second margin joined to the body adjacent to a base of the body. The web is movable to a flat position intermediate the lid and the body when the lid is in the open position. In another feature, the hinge is joined to the body along a first margin, and has a releaseable attachment by which the hinge is releasably securable to the body. The releasable attachment is intermediate the first margin and the lid. In still yet another feature, the container has a body and a rigid liner mounted within the body. The lid has a formed member matable with the rigid liner in an interference fit.

In another feature, the container has a length and a width, and a through thickness, the through thickness is less than each of the length and the width. The container has a main body having a base and an upstanding peripheral side wall. The main body has a margin distant from the base to which the lid mates in a closed position. A rigid liner is mounted within the body. The lid is joined to the body by a flexible hinge. The flexible hinge has a first connection along a margin of the lid and a second connection along the body. The hinge has a reach at least half as great as the through thickness of the body. The lid has a rigid formed member. The rigid formed member including a first region defining a first work surface. The first work surface faces upwardly when the lid is in the open position. The rigid formed member has at least a first raised retainer formed therein about at least a first region of the first work surface.

In another feature, the second connection of the hinge is along a margin of the base, and the hinge has a releasable securement intermediate the first connection and the second connection. In another feature, the rigid formed member of the lid is matingly engageable with the rigid liner in an interference fit when the lid is in a closed position.

In another aspect of the invention there is a container assembly that includes a soft-sided insulated wall structure and a flexible attachment member. The soft-sided insulated wall structure includes a top wall, a bottom wall and a peripheral wall running about the bottom wall. The peripheral wall extends upwardly away from the bottom wall and has an upper margin distant from the bottom wall. The flexible attachment member has a first end and a second end, the first end fixed to an attachment portion of the insulated wall structure. The top wall is connected to the second end of the flexible attachment member. The top wall includes an outer surface and a substantially rigid inner member. The top wall is movable between an open position and a closed position. In the closed position, the top wall, the bottom wall and the peripheral wall define an inner volume in which to receive objects. In the open position, the flexible attachment member extends away from the soft-sided insulated wall structure and allows the bottom wall and the outer surface of the top wall to concurrently lie flat such that the substantially rigid inner member of the top wall defines a work surface.

In a feature of that aspect, the container has a substantially rigid liner. The substantially rigid liner fits closely, i.e., snug, within the outer wall structure, and occupies substantially all of the inner volume. The liner has a peripherally extending rim defining a land. The substantially rigid inner member of the top wall includes a peripherally extending engagement member that includes a stiffened member. The stiffened member is operable on closing of the top wall to engage the land of the substantially rigid liner. The co-operable peripherally extending engagement member of the top wall and the land of the substantially rigid liner define a closure of the assembly, the closure so defined are zipperless. In another feature, the top wall is a substantially planar lid of the assembly. The substantially rigid inner member of the top wall includes a raised member extending out-of-plane relative to the substantially planar lid. The raised member sub-divides the working surface into sub-sections.

In another feature, the top wall has a tab extending outwardly from a second edge portion thereof, the second edge portion are opposite the first edge portion. The extending tab has a keyway extending therethrough and a releasable tab fastener on an underside thereof, the keyway adjacent to the releasable tab fastener. The peripheral wall has a tab securement fitting mounted thereon for matingly engaging the releasable tab fastener and a key adjacent to the tab securement fitting, the key are movable between a locked position and an unlocked position. In the closed position of the top wall, the releasable tab fastener is aligned with the tab securement fitting and the key is aligned with the keyway of the extending tab. When the key is in the unlocked position the key passes through the keyway and the releasable tab fastener is matingly engaged with the tab securement fitting, and when the key is in the locked position the key is unable to pass through the keyway.

In another aspect of the invention, there is a container assembly that includes a soft-sided insulated container and a substantially rigid liner. The container has a soft-sided wall structure having a top wall, a bottom wall, left and right hand short sidewall portions, first and second long sidewall portions, and a flexible attachment member. The bottom wall is substantially rectangular. The bottom wall has first and second short side edges, and first and second long side edges. The first and second long sidewall portions adjoin the first and second long side edges and extend upwardly away from the bottom wall. The left and right hand short sidewall portions adjoin the first and second short side edges and extend upwardly away from the bottom wall. The first and second long side wall portions and the left and right hand short side wall portions co-operate to define a peripheral wall running about the bottom wall. The peripheral wall has an upper margin distant from the bottom wall and a midpoint halfway between the upper margin and the bottom wall. The flexible attachment member having a first end and a second end, the first end the first end fixed to a portion of the peripheral wall below the midpoint. The top wall is generally rectangular. The top wall has an edge portion connected to the second end of the flexible attachment member. The top wall is movable between an open position and a closed position. In the closed position the bottom wall, top wall, left and right hand short sidewall portions, and first and second long sidewall portions define an internal volume therewithin. The substantially rigid liner occupies substantially all of the internal volume. It has a mouth having a peripherally extending rim defining a land. The top wall includes an outer surface and a substantially rigid inner member that includes a peripherally extending engagement member that is a stiffened member. The stiffened member is operable on closing of the top wall to engage the land of the substantially rigid liner. In the open position, the flexible attachment member allowing the outer surface of the top wall and the bottom wall to concurrently lie flat such that the substantially rigid inner member of the top wall defines a work surface on which to place objects. The co-operable peripherally extending engagement member of the top wall and the land of the substantially rigid liner define a closure of the assembly, the closure so defined is zipperless.

In still another aspect of the invention, there is a container assembly that includes a soft-sided insulated container and a substantially rigid liner. The container has a soft-sided wall structure having a top wall, a bottom wall, left and right hand short sidewall portions, first and second long sidewall portions, and a flexible attachment member. The bottom wall is substantially rectangular. The bottom wall has first and second short side edges, and first and second long side edges. The first and second long sidewall portions adjoin the first and second long side edges and extend upwardly away from the bottom wall. The left and right hand short sidewall portions adjoin the first and second short side edges and extend upwardly away from the bottom wall. The first and second long side wall portions and the left and right hand short side wall portions co-operate to define a peripheral wall running about the bottom wall. The flexible attachment member having a first end and a second end, the first end fixed to a portion of the bottom wall. The top wall is generally rectangular. The top wall has an edge portion connected to the second end of the flexible attachment member. The top wall is movable between an open position and a closed position. In the closed position the bottom wall, top wall, left and right hand short sidewall portions, and first and second long sidewall portions define an internal volume therewithin. The substantially rigid liner is sized to fit closely within the soft-sided wall structure such that the substantially rigid liner occupies substantially all of the internal volume. The substantially rigid liner has a mouth that includes a peripherally extending rim defining a land. The top wall includes an outer surface and a substantially rigid inner member, the substantially rigid inner member including a peripherally extending engagement member that includes a stiffened member, the stiffened member is operable on closing of the top wall to engage the land of the substantially rigid liner. In the open position, the flexible attachment member allowing the outer surface of the top wall and the bottom wall to concurrently lie flat such that the substantially rigid inner member of the top wall defines a work surface on which to place objects. The co-operable peripherally extending engagement member of the top wall and the land of the substantially rigid liner define a closure of the assembly, the closure so defined is zipperless.

BRIEF DESCRIPTION OF THE DRAWINGS

These aspects and other features of the invention may be understood with the aid of the following illustrations of a number of exemplary, and non-limiting, embodiments of the principles of the invention in which.

DETAILED DESCRIPTION

Figure 1A:
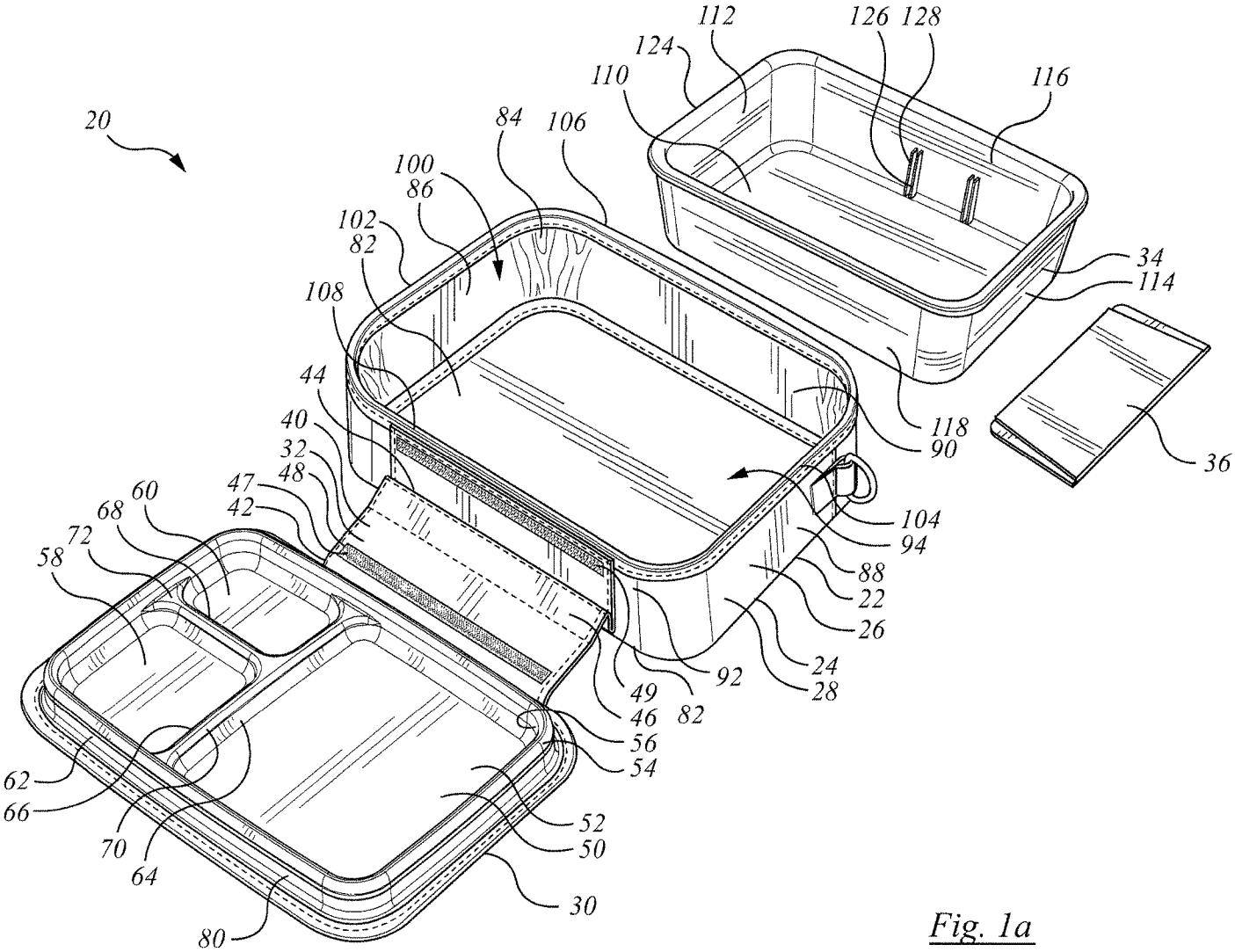
FIG. 1*a* shows a perspective view of a container assembly in an open position.

The description that follows, and the embodiments described therein, are provided by way of illustration of an example, or examples of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order to more clearly depict certain features of the invention. In the description and drawings herein, reference may be made to a cartesian co-ordinate system in which the vertical direction, or z-axis, extends in an up and down orientation from bottom to top. The x-axis extends in the shorter dimension of the container assembly, when fully expanded, running in the front-to-back direction. The y-axis extends cross-wise horizontally relative to the x-axis, running in the side-to-side direction. Unless noted otherwise, the terms "inside" and "outside", "inwardly" and "outwardly", refer to location or orientation relative to the enclosed spaces of the first and second portions of the container assembly, as may be.

The term "insulated" or "insulated wall structure" may be used in this description. It is intended to pertain to walls having a layer of thermal insulation. Typically such walls have an inner surface or lining or web, an outer surface or ligning or web, and a layer of insulation material captured between the inner and outer surfaces. The outside layer may be a wear-resistant or scuff resistant material. Thin single membranes or sheets of web material, such as woven high density Nylon ™, or vinyl ™, or leather, or paper, or polyester or PEVA, are not of themselves intended to fall within the meaning of the term "insulated" as used herein unless they have been treated or formed in an manner deliberately to enhance thermal insulating properties.

A soft-sided insulated structure is one in which the insulated panels are flexible panels, typically in the form of fabric or plastic sheets with insulation inside. In some embodiments they may be like quilted panels. In some embodiments, a substantially rigid liner is mounted inside the soft-sided insulated structure to stiffen it. The liner is typically removable, although not always. In some embodiments stiffened battens may be mounted to the soft-sided panels. The battens may be removable, or may be permanent. A soft-sided insulated structure may be understood as being in contrast to a hard-sided insulated structure in which the wall structure may be a rigid molded structure.

Referring now to FIGS. 1*a* to 1*h*, by way of general overview, a container assembly is identified as 20. Container assembly 20 includes an outer casing 22 in the nature of a soft-sided, insulated wall structure 24. Container assembly 20 has a first or main portion, 26, identified as a main body, 28, and a second portion identified as a closure member or top or lid 30. Lid 30 is secured to main body 28 by an attachment member shown as hinge 32. Hinge 32 may be a flexible hinge, and may be a fabric hinge as described hereinbelow. Main body 28 may have a substantially rigid internal liner 34.

Figure 1B:
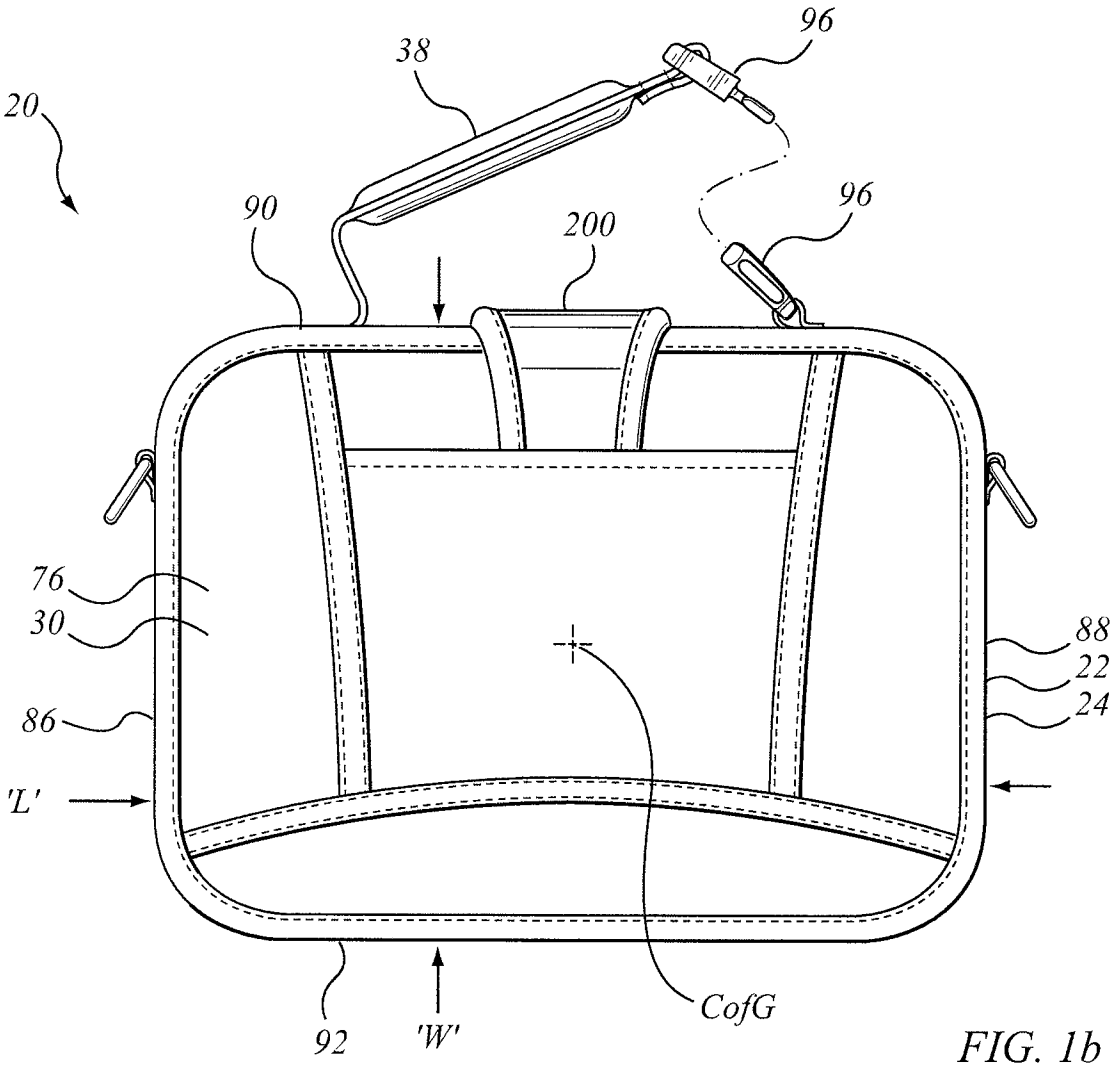
FIG. 1*b* shows a front view of the container assembly of FIG. 1*a;*
Figure 1C:
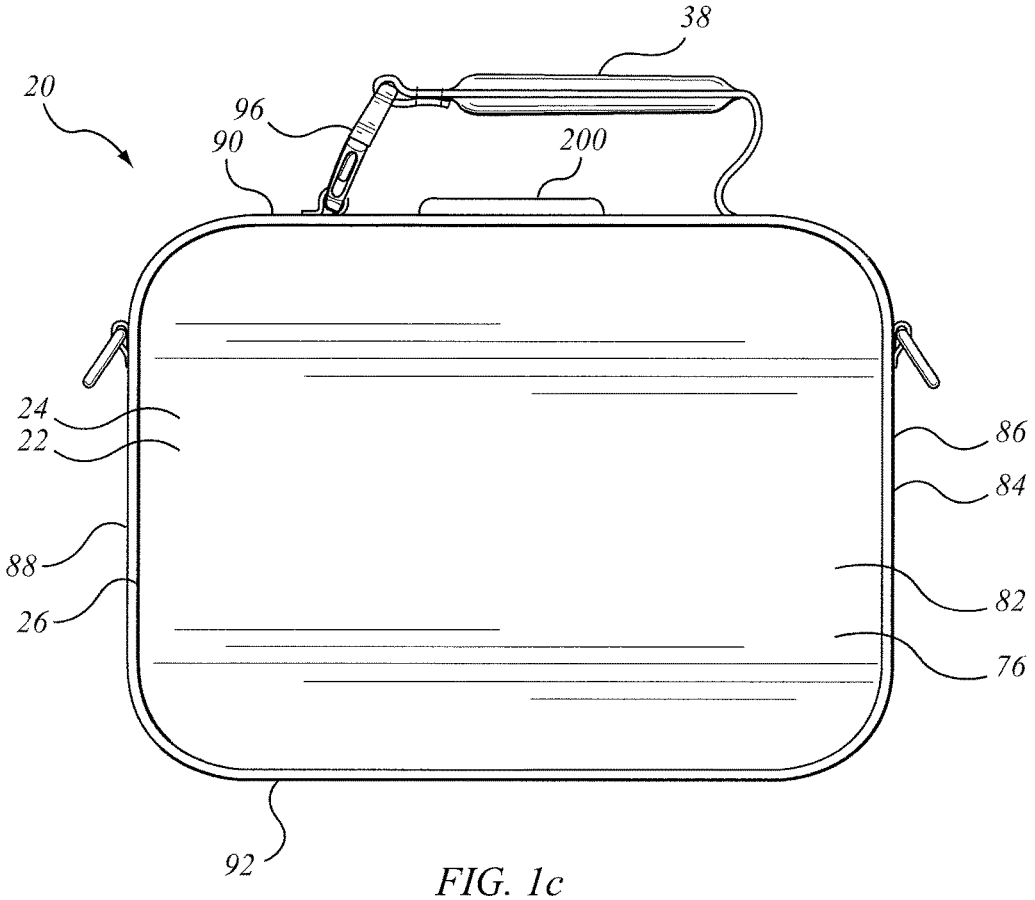
FIG. 1*c* shows a rear view of the container assembly of FIG. 1*a;*
Figure 1D:
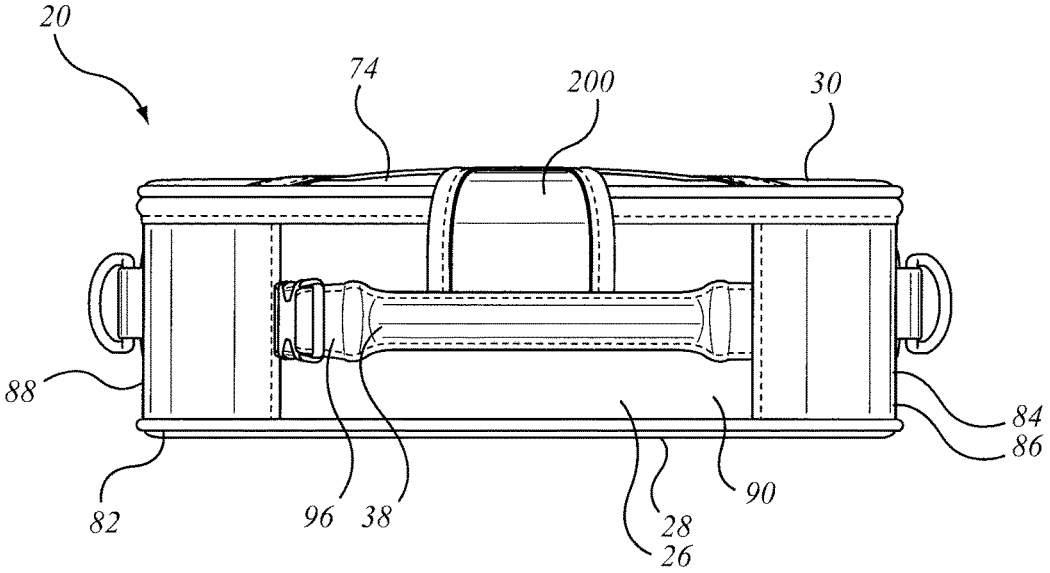
FIG. 1*d* is a top, or first long sidewall view of the assembly of FIG. 1*a;*
Figure 1E:
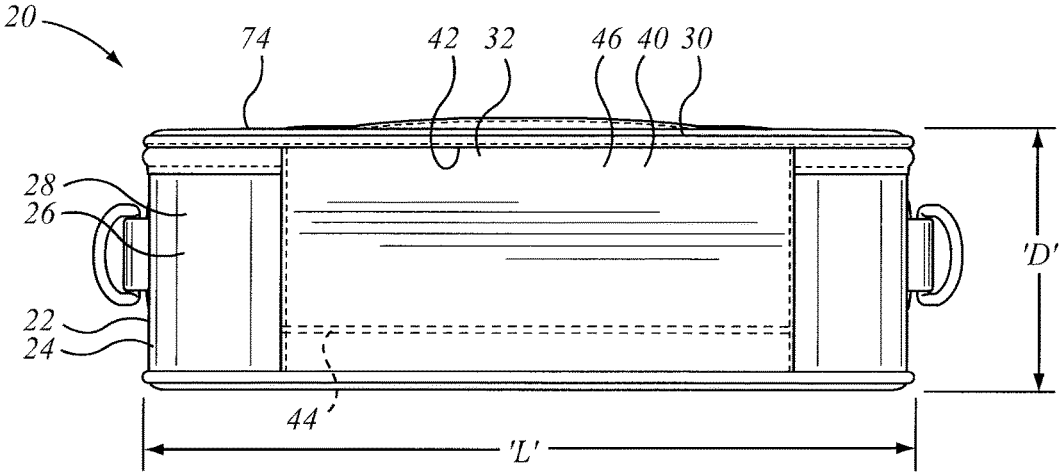
FIG. 1*e* is a bottom or second long side view of the assembly of FIG. 1*a;*
Figure 1F:
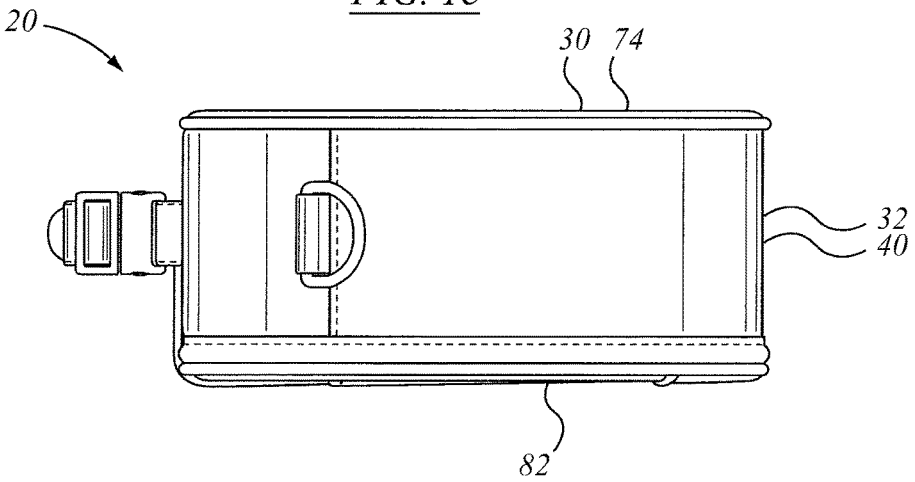
FIG. 1*f* shows a left hand side view of the container assembly of FIG. 1*a;*
Figure 1G:
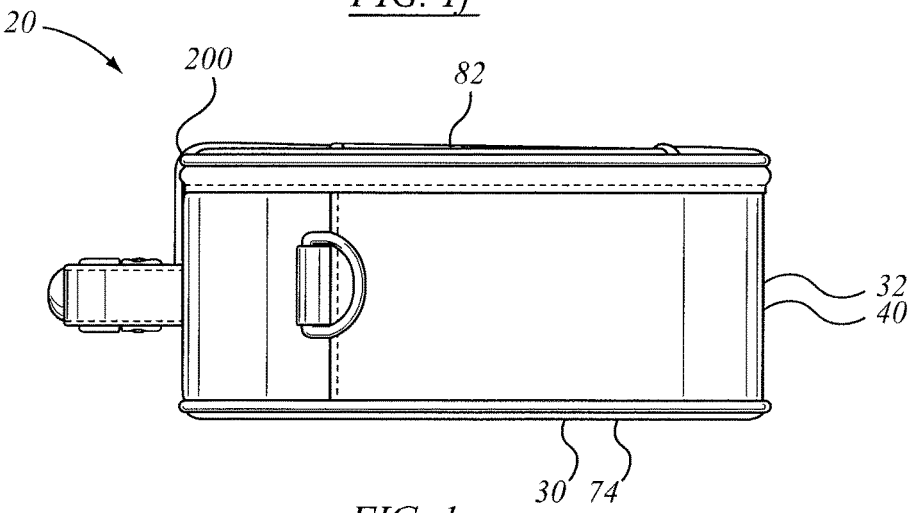
FIG. 1*g* shows a right hand side view of the container of FIG. 1*a;*
Figure 1H:
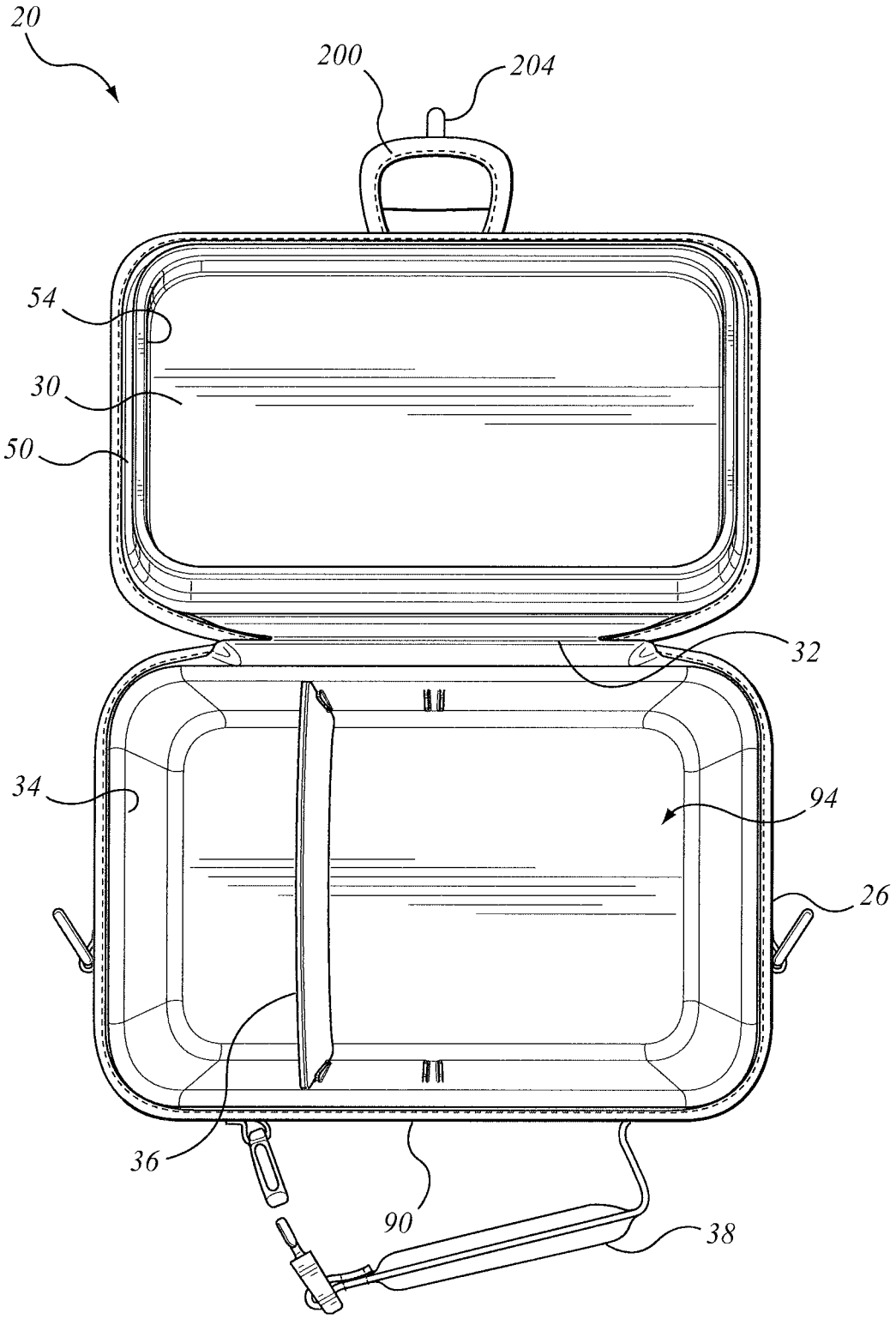
FIG. 1*h* is a view of the container assembly of FIG. 1*a* in an alternate open position.

Container assembly 20 may be generally box-shaped. It may be of the size and shape of a child's school lunch box. Clearly it can be used for snacks at any time of day, and is suitable for use by more than merely children. Container assembly 20 may have a length 'L', a width 'W' (as seen in FIG. 1*b*) and a depth 'D' (as seen in FIG. 1*e*). Length 'L' may be taken as exceeding width 'W', and both may be greater than depth 'D'. Although assembly 20 could be square in plan view, in some embodiments the dimensions may lie in the range of L:W of 3:2 (+/−25%), and L:D of 3:1 (+/−25%), and in one embodiment L:W:D of about 3:2:1 (all +/−25%), such that the inner liner may be a relatively shallow tray. In another embodiment, this ratio of L:W:D may be roughly 5:3:2 (all +/−25%), for the region enclosing the liner.

It may be noted that in the embodiment of FIGS. 1*a*-1*h*, the lifting member, i.e., handle 38, is mounted on one of the long sides of the box, such that when the lunch box is carried, the long dimension is fore-and-aft horizontal. In the embodiment of FIGS. 2*a*-2*i*, handle 222 is mounted on the short side, such that when the container is carried the long dimension is substantially or predominantly oriented up-and-down in the vertical direction. In either instance, while being carried the wall portion with handle 38, or handle 222 as may be, is the top panel, and the opposite side is the bottom. In either case, when the lunch box is to be opened it is typically placed with the large rear panel on a suitable surface, such that the rear panel may then be termed the bottom side. The large front panel then faces upwardly as the top side, and is then the lid which is movable between closed and open positions.

Attachment member 32 may have the form of a hinge, 40. Hinge 40 may have the form of a fabric or web hinge, and may be accordingly flexible. Hinge 40 may have a first margin or termination or edge, 42, that is connected to, or mounted to, or attached to, a margin of lid 30. Hinge 40 has a second margin, or termination, or edge, 44, that is connected to or mounted to or attached to main body 28 distant from lid 30. Hinge 40 may have a reach 46 defined between edges 42 and 44. That reach may be greater than half the depth (in the z-direction) of the box.

In a first embodiment, reach 46 may correspond to roughly half the depth, such that when lid 30 is opened, hinge 40 may fold back on itself and lid 30 may lie on the suitable supporting surface next to main body 28. In the open position, where the suitable surface is flat, the lid will also tend to lie flat, roughly at the same level as the bottom or rear panel of container assembly 20 more generally.

In a second embodiment reach 46 may be greater than half the depth, such that lid 30 may lie a bit away from main body 28. In another embodiment, reach 46 may be substantially equal to the depth of assembly 20 in the z-direction, such that reach 46 may fold out sideways from main body 28 with lid 30 distant therefrom.

In an optional embodiment, hinge 40 may include a releasable securement 48. Releasable securement 48 may be located intermediate edge 42 and edge 44. Releasable securement may have the form of a fabric fastening strip, of which one type is commonly known as Velcro™. Securement 48 may include a male strip 47 and a mating female strip, 49. It is substantially arbitrary which is which. One strip is mounted to reach 46; the other is mounted to main body 28. They are located near the upper margin of the peripheral wall of main body 28, such that when attached, lid 30 may tend approximately to pivot about, or close to, the upper edge of hinge 40. By contrast, when released, a greater length hinge 40 may hinge, permitting lid 30 to lie flat.

Lid 30

As may be noted, lid 30 is tethered to main body 28 by a securement in the nature of reach 46 of hinge 40, such as may tend to discourage the two parts from being separated, or lost. At the same time, lid 30 may lie flat. The outside surface of lid 30 may face downward and lie upon the suitable surface. The inside surface of lid 30 may tend to face upwardly, and in so doing, may present a surface upon which to place items. For example, it may be a surface upon which to rest one's sandwich, or soup, or canned drink, or fruit serving, and so on.

Lid 30 may include a stiffener member 50. Stiffener member 50 may include a first portion 52 that extends as a substantially planar layer or web. Stiffener member 50 may be substantially co-extensive with lid 30, generally, whether lengthwise (in the x-direction side to side, parallel to hinge 40) or depth-wise (in the y-direction, front to back perpendicular to hinge 40), or both. First portion 52 may be substantially flat, and may present a work surface on which to rest objects, or upon which objects may be processed, as by cutting or slicing with a knife, or mixing in a bowl, and so on. Stiffener member 50 may have a retainer, or retainer array, 54, that extends about first portion 52. The retainer or retainer array may have the form of a raised member, or members that stand proud of first portion 52, such as may tend to discourage or to limit the range of sliding of objects placed on main portion 52. While a series of raised blisters or pegs may be used, in some embodiments it may be that retainer 54 may have the form of a raised peripheral wall or flange or rim, as at 56. It may be that there is more than one work surface portion such as item 52, or a work surface portion such as item 52 may be divided into two or more sub-regions. For example, there may be a second region 58, and a third region 60. It may be that all of first, second, and third regions 52, 58 and 60 are container within a common external peripheral retaining wall 62 of a first height, and individual first, second and third sub-dividing retainers as at 64, 66 and 68, which may be of a lesser height than wall 62. It may be that a first cross member 70 divides the work surface, or work surfaces across the body of stiffener member 50 in one direction, and a second cross-member 72 further subdivides the space. Cross-members 70 and 72 may be channel shaped in cross-section. Cross-members 70 and 72 may intersect. The side faces of cross-members 70 and 72 may define at least portions of members 64, 66 and 68. It may be that member 50 is a molded plastic member. That panel may have a scuff-resistant outer layer 76. The wall structure of lid 30 (when the unit is lying on its back) or front panel (when the unit is being carried), may be such that the outside surface of stiffener member 50 is covered by, or contained within, an insulated soft-sided panel 74. Alternatively, the front panel may omit the relatively thick insulated layer, and may employ a more skin-like covering, such as may be a grade of NYLON, whether sheet or woven, and indicated as 160 in FIG. 5*b*.

Figures 5A, 5B, 5C:
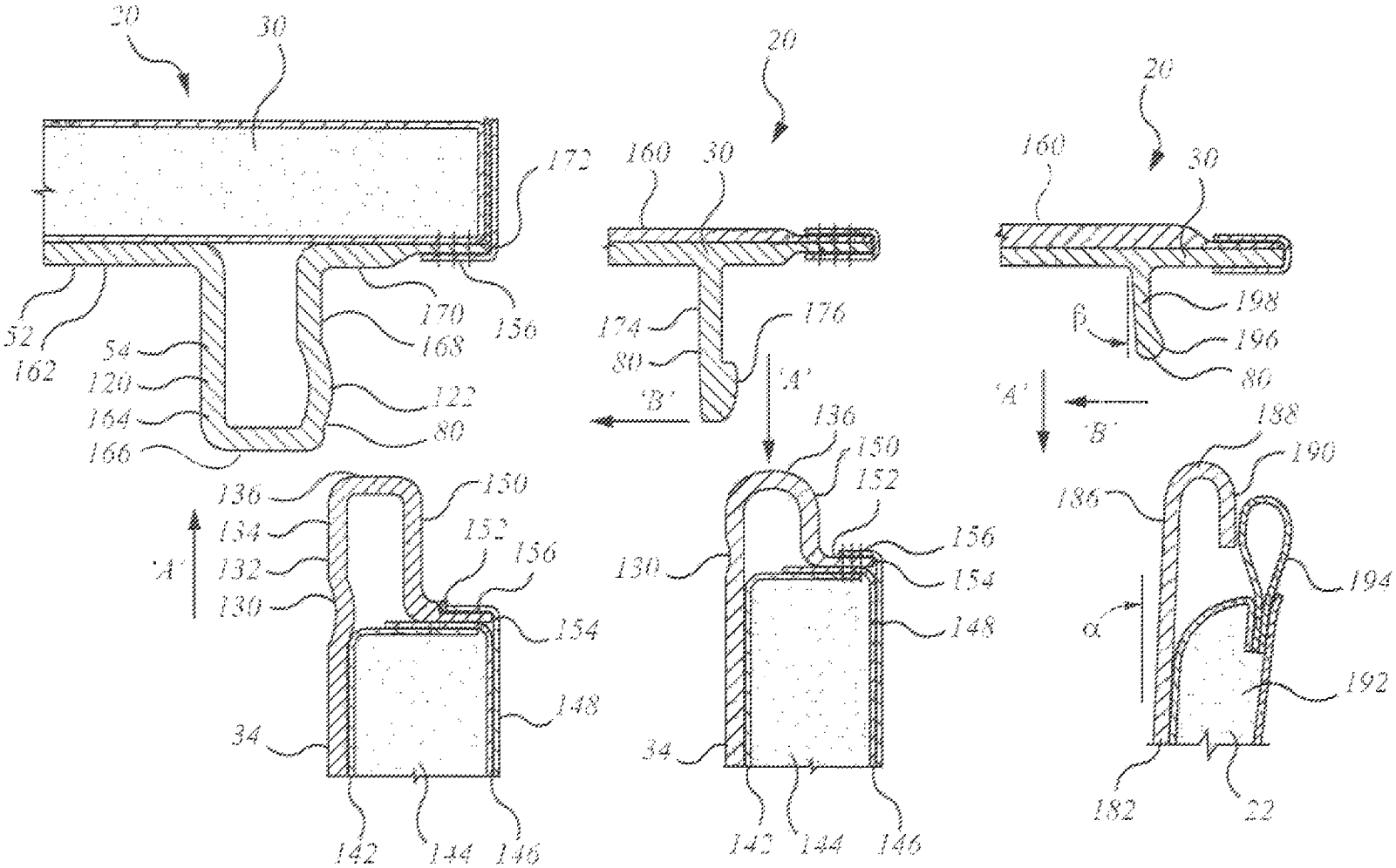
FIG. 5*a* is a section showing engaging closure members of the container assembly of FIG. 1*a;*
FIG. 5*b* shows a section of an alternate set of engaging closure members to that of FIG. 1*a;*
FIG. 5*c* shows a section of an alternate set of engaging closure members to that of FIG. 1*a;*

Lid 30 may also include a closure engagement member, or a closure engagement array, 80 for interaction with main body 28. It may be that the closure engagement member 80 may be a separate fitting, or it may be defined at least in part by retaining wall 62. Three embodiments of member 80 are shown in FIGS. 5*a*, 5*b*, and 5*c*, described below.

Structure and Fabrication of Outer Casing 22

In respect of outer casing 22, lower or main portion 26 may have a base wall, or rear wall 82, that may, when soft-sided insulated lunch box 20 is placed on a generally flat surface, lie flat on the ground. A peripheral wall 84 is joined about the four margins of base wall 82, and extends away therefrom. Peripheral wall 42 may include four sides or side panels, or side members. The bottom panel, or rear panel of base wall 82, may be an insulated wall. Base wall 82 and insulated wall panels, namely a pair of left and right hand side panels 86 and 88, a front panel 90, and a rear panel 92. The choice of nomenclature of front and rear, left and right, orientations is arbitrary. Each panel 82, 86, 88, 90 and 92 may be located at substantially right angles to two adjacent wall panels. The combination of panels defines a space or volume, or compartment 94. Panels 82, 86, 88, 90 and 92 may be fastened or joined or attached to one another by sewing, gluing or some other suitable fastening means. Alternatively, two or more panels (including the bottom panel) may be formed from a single piece of material having one or more folds therein to define the two or more panels.

In one embodiment, the front, bottom and rear panels may be made from a single piece of insulated material.

In one embodiment, the portions of the peripheral side wall, being panels 86, 88, 90 and 92 may each have an upper, or distal, edge 102, 104, 106 and 108, respectively, which are also free edges, the four edges co-operating to define a container opening 100 through which receptacle 34 may be placed into compartment 94. Lid 30 is hingedly, or pivotally attached to main body 28. Rather than employing a zipper (or, optionally, in addition to a zipper, if a zipper is desired), internal structural member 80 may tend to engage the mouth of receptacle 34 in a relatively tight interference fit, thus effectively securing lid 30 to inhibit heat transfer to and from compartment 94.

In one embodiment, where base wall 40 may be substantially square in plan view, the four sides of peripheral wall 42 may be equal. In the general four-sided layout, the layout, whether square or not may be considered to have two opposed long sides (90, 92) and two opposed short sides (86, 88). Sides 86, 88, 90 and 92 may themselves be considered to be substantially rectangular, although they may also be trapezoidal. In any event, base wall 82 and side wall members 86, 88, 90 and 92 may co-operate to define a five-sided open topped box.

That is, container assembly 20 has a rear wall, namely base wall 82 that may also be a bottom wall when container assembly 20 is lying on its back, and a generally rectangular peripheral wall or sidewall 84 that has left hand and right hand short sidewall portions 90, 92 and top (when carried) and bottom (when carried), first and second long sidewall portions 86, 88 that co-operate to form the four-sided shape. A handle 38 is mounted to the top sidewall portion, i.e., first long sidewall portion 86, to permit container assembly 20 to be hand carried. Handle 38 may have a detachable and re-attachable release member, such as quick release 96, shown in separated condition in FIG.1*b*, and connected in FIG. 1*c*.

The front wall of container assembly 20 may also be the top, i.e., lid 30, wall when container assembly 20 is lying on its back (i.e., base wall 40) to be opened. The top panel, or lid 30, has an internal structural member or substantially rigid liner member 70 for engagement with the upper portion of receptacle 32, thereby acting as a closure member to control access to the enclosed chamber 38 defined within receptacle 32. Internal structural member 70 has a peripherally extending seal member 72 for interferingly engaging the mouth of receptacle 32. Lid 30 may tend to deter the egress of materials that might otherwise occur when container assembly 20 is inadvertently tipped over or jostled excessively energetically. Lid 30 may also include such features as may permit lid 30 to provide a relatively stiff surface upon which to place objects, such as, for example, foods or beverages.

When lid 22 is in a closed position, heat transfer may be inhibited to a greater extent. The insulative material may additionally be soft, such as resilient foam so that the container may tend not to damage, or be damaged by, objects with which it may come into contact. The outer facing layer of the panel (be it 82, 88, 88, 90 or 92) can be an outer skin in the nature of a canvas or Nylon™ covering layer for resisting abrasion. The inner face of the insulation layer can be covered by an inner skin in the nature of a flexible sheet, whether of vinyl™ or of plasticized metallic foil sheeting that is shiny and reflective. The metallic foil sheeting material may be the type sold under the name Therma-Flect™. The inside of compartment 56 can be lined with white vinyl sheeting on its forward and bottom sides. If a suitable plastic or other material or stain resistant surface coating or surface treatment is used, then outer casing 94 may also be readily cleaned to remove dirt and other debris acquired through use.

The Liner

The reinforcement member, or stiff wall structure, in the nature of a relatively, substantially, or predominantly rigid, resilient, molded plastic tub, or liner, indicated as receptacle 34 may typically be made of a molded high-density plastic. Receptacle 34 is removable from within wall structure 24, to facilitate washing thereof. When receptacle 34 is in place, container portion 26 is intended to be maintained in the shape shown in the Figures, and is not intended to be collapsible.

Receptacle 34 may be rigid to provide a degree of protection to items stored therein from external forces caused, for example, by bumping, jostling, or knocking of container assembly 20 when it is transported or otherwise used. At the same time, receptacle 34 may tend to be sufficiently lightweight that it may not make container assembly 20 unduly heavy for a child to carry when container assembly 20 is filled with items such as sandwiches, snacks and juice boxes. A relatively tough plastic is preferred because it may tend to resist breakage, it can contain melting ice and spilled liquids, and it may be readily cleaned.

Likewise, receptacle 34 may have a first or main or bottom or base panel 110 and a side wall 98 having side portions 112, 114, 116 and 118 that correspond respectively to sides 86, 88, 90 and 92 of receptacle 34.

Insulated container main portion 26 may include a divider or partition 36. Outer casing 22 defines a has a relief or accommodation, or chamber, or space, or compartment in which to receive receptacle 34, and receptacle 34 has a seat, or a plurality of choices of seats into which a partition or partitions 36 may be placed. Partition 36 may be used to separate items placed within receptacle 34. A closure member such as lid 30, attached to outer casing 22, may be used to govern access to the inside of container assembly 20, lid 30 being movable between a first, or closed, position, and a second or open position. FIG. 1*a* shows container assembly 20 with lid 30 in an open position. A lifting member, or carrying member, such as a strap or grip or handle 38 may be attached to outer casing 22 to facilitate transport of container assembly 20.

Liner walls 112, 114, 116, 118 extend from the bottom of receptacle 34, and each wall terminates at a free edge that together define a receptacle rim, or edge 124 of generally rectangular plan form, with radiused corners. Receptacle edge 124 may be generally equidistant from bottom 110 (i.e., lies in a parallel, upwardly spaced plane) and defines a receptacle by which to obtain access to the internal chamber. The liner may include indexing features 128, such as may be in the nature of wall mounted grooves or slots 126, which may be molded in liner or receptacle 34. Slots 126 may be placed intermittently along receptacle 34 to permit a partition 36 to be installed, thereby dividing the internal space into halves, or a 2:1 or 3:1 split, as may be. The internal liner member may be a removable tub, or vessel, or may be secured to the soft-sided outer wall assembly. In either case, the liner may fit quite closely, or snuggly, inside the soft-sided insulating walls, and may occupy substantially all of the internal volume within the soft-sided walls.

Zipperless Closure Member and FIGS. 5*a*, 5*b* and 5*c*

Container assembly 20 includes a pair of matingly engaging peripheral wall portions. Those portions may include a female land 132, which may be in the form of a debouchment, or mouth, or rim 134 of a substantially rigid (as compared to the insulated soft sided wall portions) structural member such as a liner in the nature of a receptacle or bin, or tub, however it may be called. Rim 134 may be opposed by a male closure of securement member such as the front or top panel reinforcing peripheral member 120. Member 120 may include a bezel-like upstanding peripheral interference fit engagement member, which may have a peripherally outwardly facing fitting, such as an interference bulge or detent 122, such as may tend to encourage a positive interference between the two mating members, and which may co-operate with an opposed, corresponding detent feature, such as a relief or cusp 130 in the surrounding land defined by rim 134 (see detail of FIG. 5*a*, when parts are forced together in the direction of phantom arrow 'A'). FIG. 5*a* also shows an embodiment of wall structure. As may be noted, the wall structure includes the substantially rigid liner member receptacle 34, the external soft-sided insulated wall having an inner skin 142, an insulated layer, 144, and an outer skin 146. This wall structure may also include a further outer protective layer of heavier, scuff resistant material 148, or the scuff resistant material may be used in place of outer skin 146.

In the embodiment of FIG. 5*a*, the outer, or female interference fit engagement assembly includes a molded re-entrant lip that may include cusp 130, an end wall 136, and an outer, return leg 150, such that the land region, end wall 136 and return leg 150 may tend to co-operate to function as a channel section tending to stiffen the peripheral lip or rim 134 more generally. At the inward end of outward return leg 150 there may be a laterally extending leg, such as may be identified as flange 152, to which the soft sided wall structure may be secured by an attachment. The attachment may be a bonding agent, or, the distal portion 154 of flange 152 may be thinned to provide a land through which stitching 156 may be passed to secure the liner to the wall structure, or stitching and bonding may both be employed to discourage removal of the substantially rigid liner from the soft-sided wall structure.

The embodiment of FIG. 5*a* may employ a formed externally facing interference fit reinforcement, in the nature of a lip or rim member 134 that may extend peripherally about a main planar lid panel portion 52. Lip member 134 may have an out-of-plane inner leg 164, distal end portion 166, return leg 168, and outer peripheral flange 170, and thinned outer finger 172 through which a stitched connection to the front panel covering assembly, be it a cellular foam insulated panel (FIG. 5*a*), or a thinner covering (FIGS. 5*b* and 5*c*), can be made. In FIG. 5*a*, leg 164, end portion 166 and leg 168 co-operate with the adjacent planar portions 162 and 170 to function as a reinforcing channel for the adjacent planar regions, thus tending to yield a stiffened member for engagement with the surrounding land of the liner.

In the alternate embodiment of FIG. 5*b*, lip member 134 may be replaced by a cast panel having a peripheral lip having a solid, as opposed to hollow or channel like, leg 174, having a bulbous, or fattened distal end portion 176 such as may deflect in the direction of Arrow 'B' when the male and female parts are forced together by motion in the direction of arrow 'A', in the manner of a cantilevered spring flexing to give an interference fit. In these embodiments there is, commonly, an engagement interface that is free from tracked fasteners, or, as it might be alternatively termed, the friction interface is 'zipperless'.

In the further alternative embodiment of FIG. 5*c*, the container assembly, be it assembly 20 or assembly 220, may include a receptacle, or vessel or liner, or tub 34 that may be removable from within the surrounding soft-sided wall structure, indicated generally as 22. The container assembly may be generally similar to those of FIG. 5*a* or 5*b*. Similarly, the surrounding soft-sided wall panels may include an outer covering, a layer of thermal insulation, and an inner wall covering, all generally analogous to the structure described above. However, tub 182 may differ from receptacle 34, in having an upstanding sidewall structure that may include a flare or splay, such that the wall 186 may be inclined outward from the vertical, as indicated by angle a such that the closure is tapered. The upper rim 188 of tub 182 may be formed to have a leg folded or bent back upon itself, such as leg 190, which is, in effect a rim stiffening flange. The soft sided insulated side wall structure 192 may end at a bead, or piping, 194 which may sit peripherally outside rim 188. The lid or top panel 30 may be substantially the same as before, except insofar as downwardly extending leg 198 may be angled or splayed, such as in the outward direction measured from the vertical as indicated by angle β. Leg 198 may extend peripherally about top panel, forming a continuous peripheral depending wall. Leg 198 may include a bulbous head, such as may include an outwardly extending bead 196. In operation, when the lid is closed onto the tub, as suggested by motion in the direction of arrow 'A' in FIG. 1*l*, bead 196 may tend to engage the opposing land of wall 186 in an interference condition, such as may tend to urge leg 198 inwards in the direction of arrow 'B' and which may tend to urge rim 188 outwards in the direction opposite to arrow 'B'.

Latch

An opener, grip, or pull, which may be in the nature of a tongue, or pull tab 200 may assist in opening the lid, namely front wall or lid 30 away from the remainder of the insulated sidewall portions, thereby yielding access to the interior chamber. Tab 200 is attached externally to lid 30, and the inside, or underside, however it may be called, of the distal portion of tab may include a releasable fastener, which may be a hook and eye fastener, such as one of a mating pair of VELCRO strips, the mating strip, or patch 202 being mounted to first long sidewall portion 90 in the region lying within the span of the bail of handle 38. The mating hook and eye portions may function as a releasable attachment or securement, or latch member, such as may, when mated together, further discourage disengagement of the friction fit interface. When secured, the release member 204 may tend to secure, or lock, lid 30 in place. When lifted, the release member 204 may tend to aid in disengaging lid 30 from receptacle 34. Tab 200 is grasped to release the mating portions of a hook and eye fabric strip securement, and to permit the interference fit seal of lid 30 inside receptacle 34 to be broken, and lid 30 moved pivotally about its rearward hinged edge between the closed, or sealed position, and an open, and unsealed, position.

FIGS. 2*a*-2*i*

In FIGS. 2*a*-2*i*, an alternate embodiment of a box-shaped, soft-sided insulated container assembly is identified as 220. Container assembly 220 is generally similar to assembly 20, with the corresponding item numbers used for similar parts. In this case however, handle 222 is not mounted to one of the long side portions, as is handle 38, but rather placed along one of the short side portions 224, with the roots of the handle strap being secured along the corresponding opposed long sides, such that, in the customary orientation for carrying, hinge 40 may lie along one of the ascending (or descending), predominantly vertical sides of the friction fit interface, as may the pull tab member 200, and the portions of the friction fit interface lying along the short side portions may tend to be predominantly horizontal.

Lid 30 may include internal structural member 230. The general cross-sectional structure of lid 30 may include an outer skin, an intermediate layer of thermal insulating material, such as may be a layer of closed cell foam, and an inner wall, or skin, provided by internal structural member 200. A heavy fabric strip may be folded over the combined edges of the fabric outer skin and the external lip of structure member 230 and the laminate so formed is then sewn together, the stitches passing through lip 280. In this way a thermally insulative sandwich structure is formed.

Figure 2A:
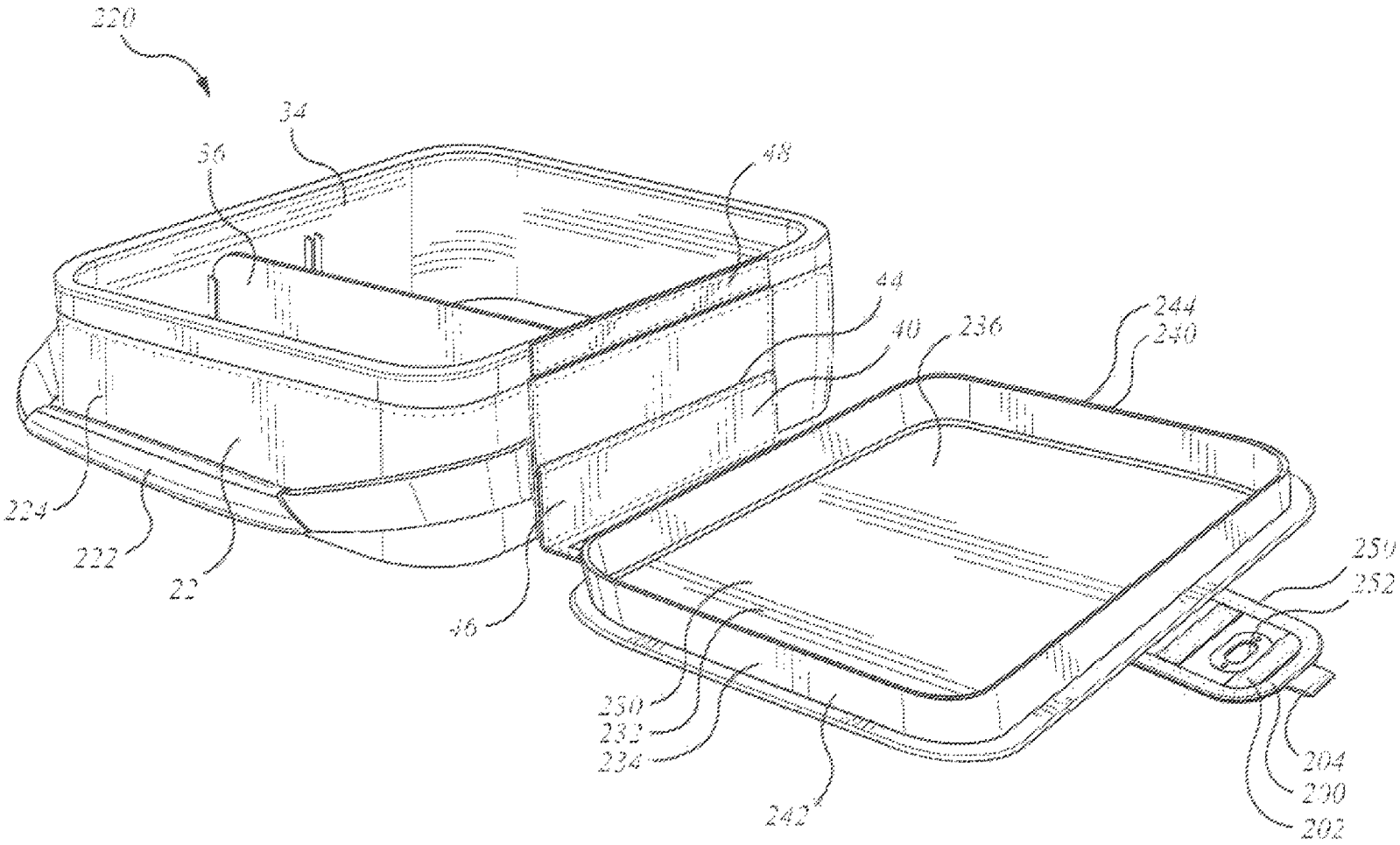
FIG. 2*a* is a perspective view of an alternate container assembly to that of FIG. 1*a*, in perspective view in an open condition.
Figure 2B:
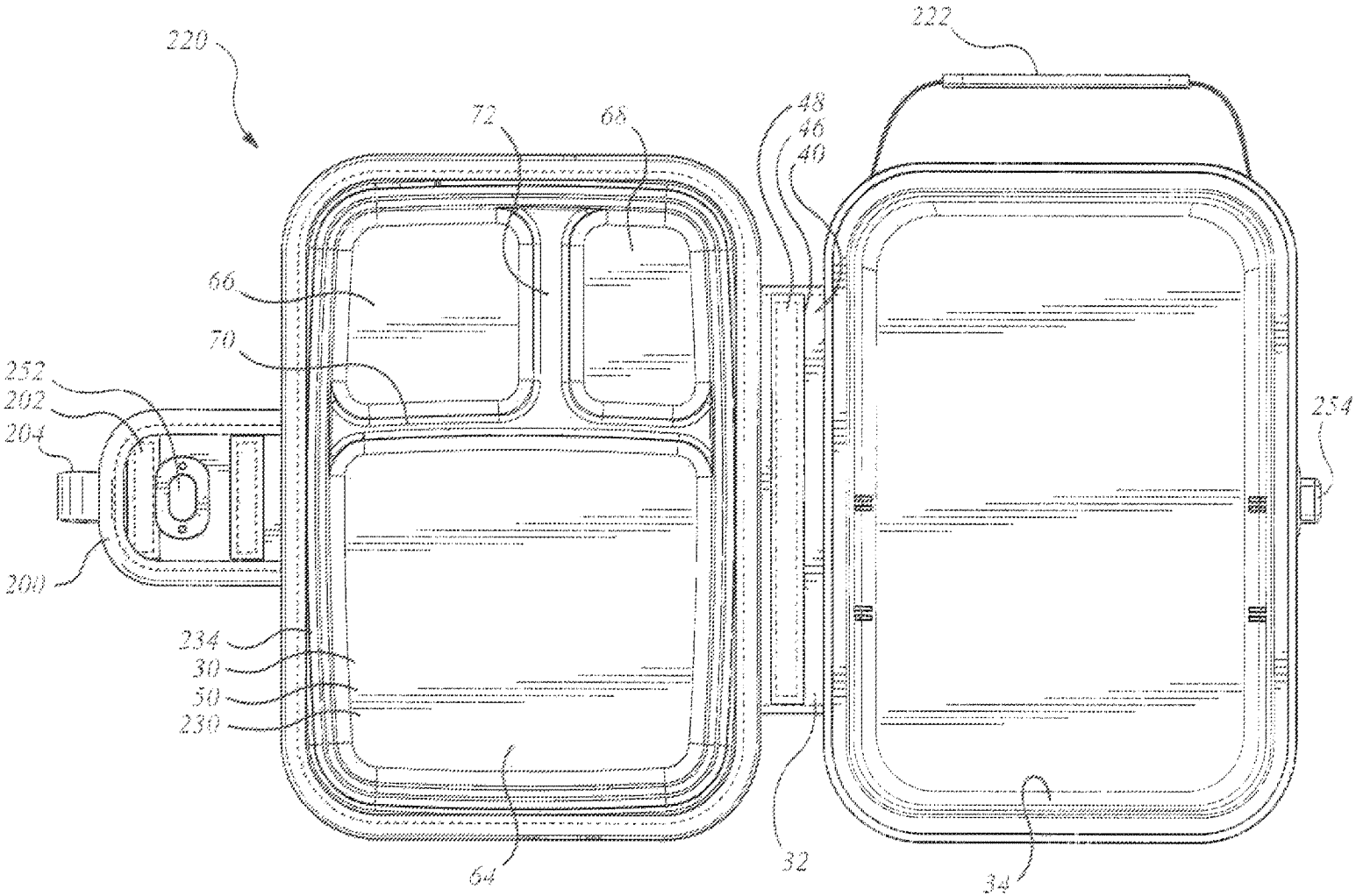
FIG. 2*b* is a plan view of the container assembly of FIG. 2*a* in the open position.

In one embodiment, as shown in FIG. 2*a*, internal structural member 230 may include a substantially planar medial web portion, 232, that is generally rectangular in plan view (reflecting the generally rectangular plan form of container assembly 220, more generally). A raised retainer in the form of an integrally formed bezel, or surround member 234 extends peripherally, and continuously, about web portion 232, much in the manner of a picture frame, or peripheral flange. A work surface 236 lies within the region bounded by surround member 234. Surround member 234 is generally rectangular in plan view, and the outside flange may interact in an interference fit relationship with at least a portion of the similarly rectangular plan view outline of the mouth of receptacle 34. If receptacle 34 were circular, or elliptical, or oblong, surround member 234 would also tend to be correspondingly circular, or elliptical, or oblong to permit satisfactory mating engagement. The peripherally outermost portion, or extremity, of surround member 234, is peripheral lip 240. Lip 240 may lie in the plane of web portion 232 (although it need not do). Inwardly of lip 240 is an upstanding, outwardly facing wall member 242. Wall member 242 terminates at an end wall portion 244 that may extend in a plane generally parallel to the plane of web portion 232 (although end wall portion 244 could be a continuously radiused portion, or could be beveled, as may be). In this example there is a single working surface region that occupies substantially the entire area of lid 30, and is shown without internal dividers. This may be seen in contrast to the embodiment shown in FIGS. 1*a* and 2*b* in which the total working surface area is divided into a plurality of sub-regions, namely the first, second, and third regions noted above.

As may be noted, the interface of the seal fitting with the land region of receptacle 34 is intended to be sufficiently tight that it may tend to resist re-opening. To that extent, the interface between lid 30 and the lower portion of container assembly may tend not to require a zipper, and may be zipperless, that is, free of any peripheral tracked fastener. In the open position, the inner structural member 230 is formed to define work surface 236 on which to place objects, as before. The attachment member 32 again allows the work surface 236 to lie substantially flat while the container assembly 220 remains on its back, allowing access to remove objects stored in receptacle 34. As before, attachment member 32 also tends to ensure that lid 30 remains secured to container assembly 220 at all times. This may tend to prevent the lid 30 from being separated and potentially lost or misplaced due to inattention or distraction.

As before, attachment member 32 is connected to the container assembly 220 at peripheral wall 56. The soft-sided shell of container assembly 220 may have a midpoint about halfway between the bottom wall and the upper margin of peripheral wall 56. The attachment may be located at or below this midpoint, for example. Thus, as above, attachment member 32 is of sufficient length, or reach, to permit lid 30 to engage with the female land of liner 34 so that lid 30 can be moved to the closed position or the adjacent lying-flat open position.

As explained above, the lip or rim 134 may extend peripherally about top panel 224, forming a continuous peripheral depending wall. The lip member extends out of the plane of the planar medial web portion 232, and in additional to providing a stiffened member for engaging with the land of the liner, rim 134 also prevent objects from sliding off structural member 226 when being used as work surface.

Figure 2D:
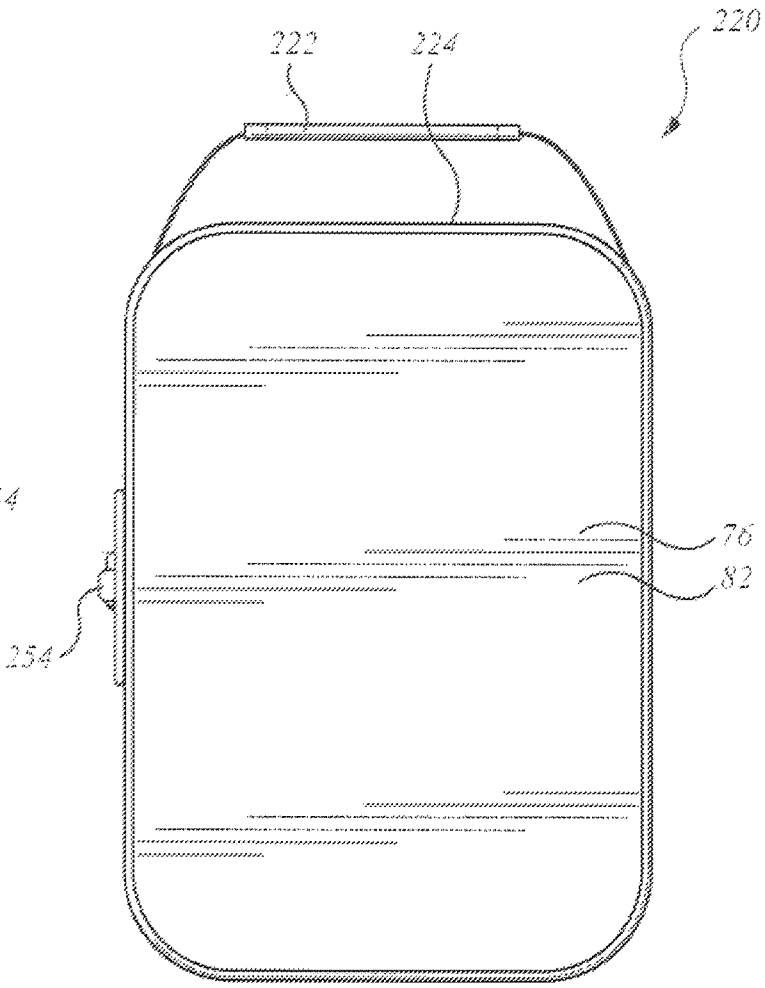
FIG. 2*d* shows a rear view of the assembly of FIG. 2*a* in a closed position.
Figure 2C:
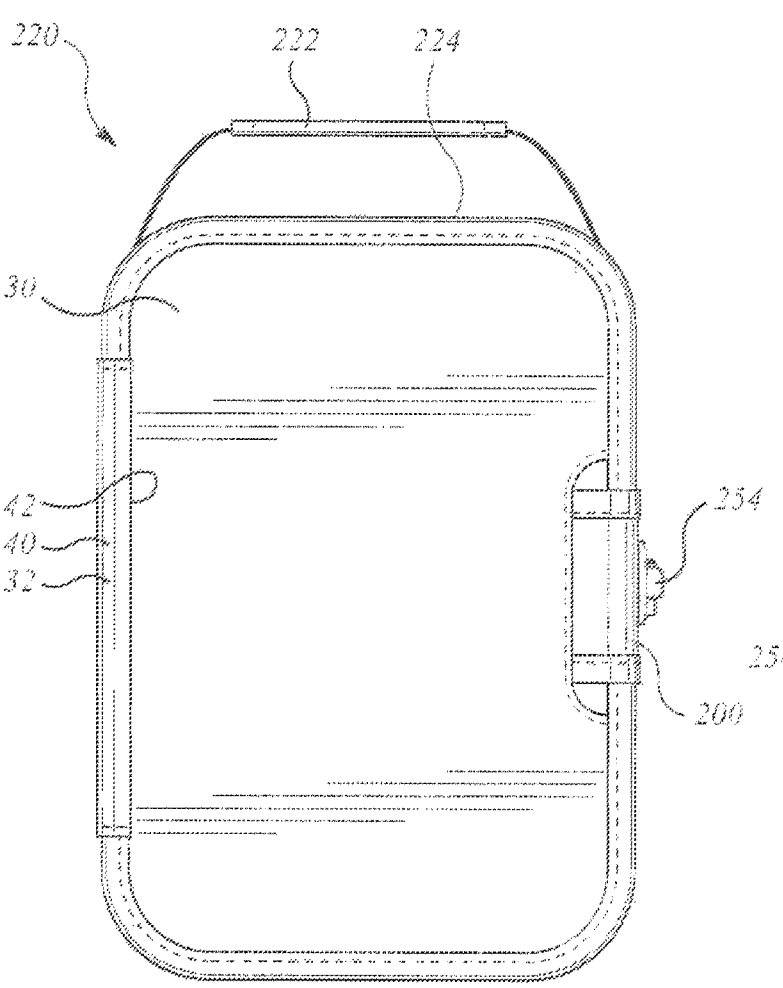
FIG. 2*c* shows a front view of the assembly of FIG. 2*a* in a closed position.
Figure 2E:
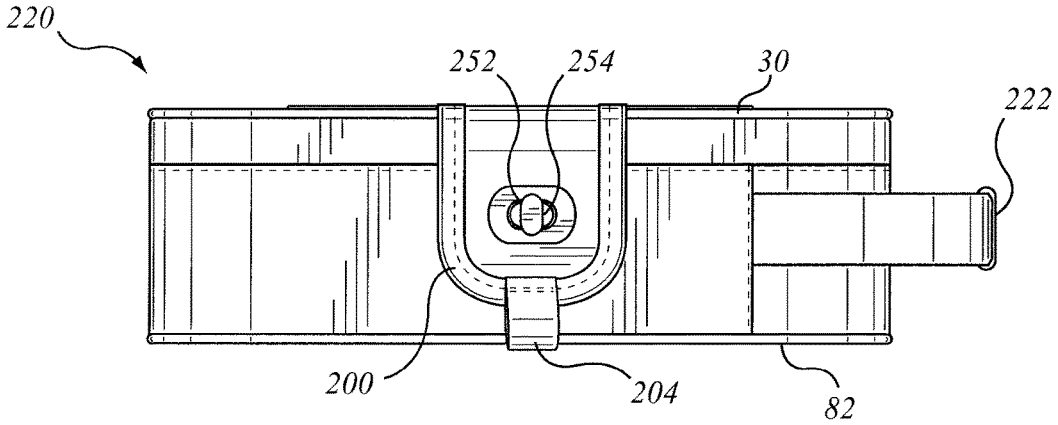
FIG. 2*e* shows a first long sidewall view of the assembly of FIG. 2*a* with a fastening tab in a closed position.
Figure 2F:
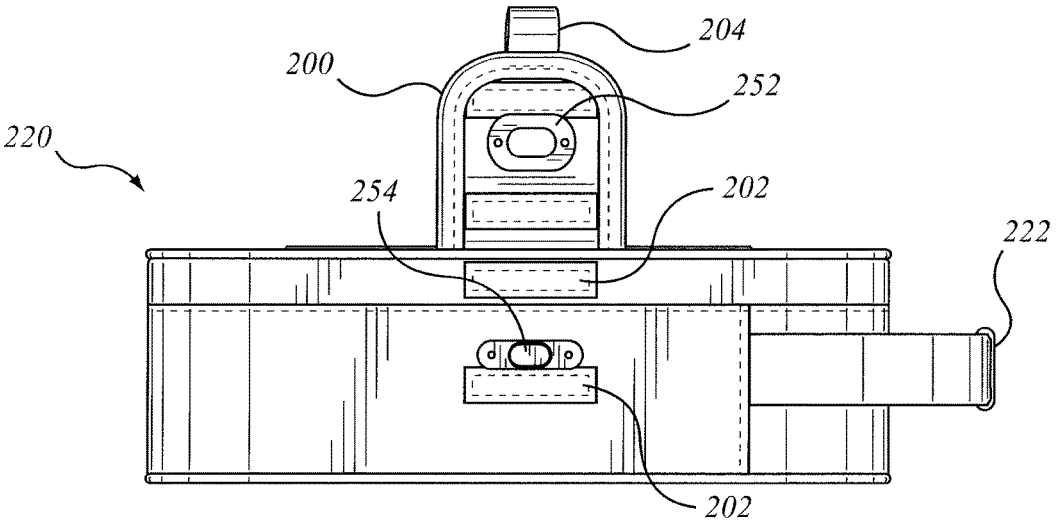
FIG. 2*f* shows a first long sidewall view of the assembly of FIG. 2*a* with the fastening tab in an open position.
Figure 2G:
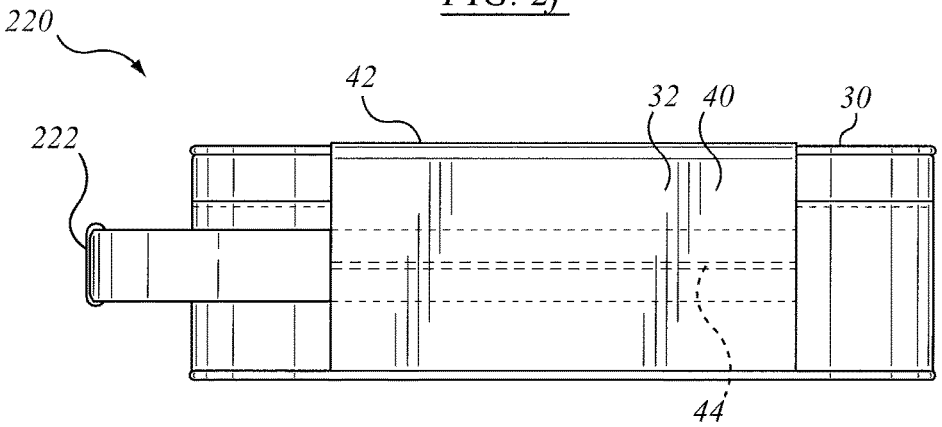
FIG. 2*g* shows a second, opposite long-side view to that of FIG. 2*e;*
Figure 2H:
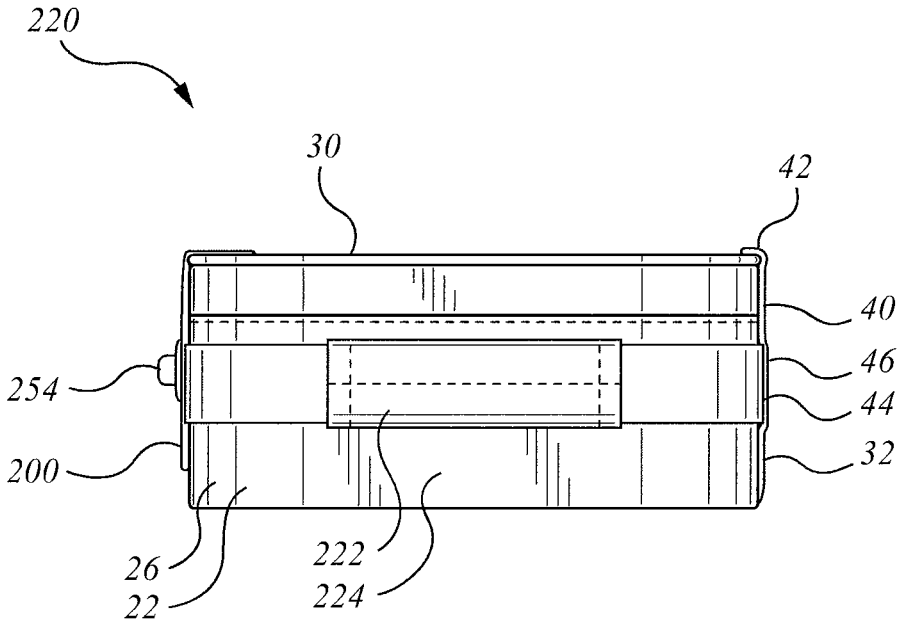
FIG. 2*h* shows a first short-end view of the container assembly of FIG. 2*a;*
Figure 2I:
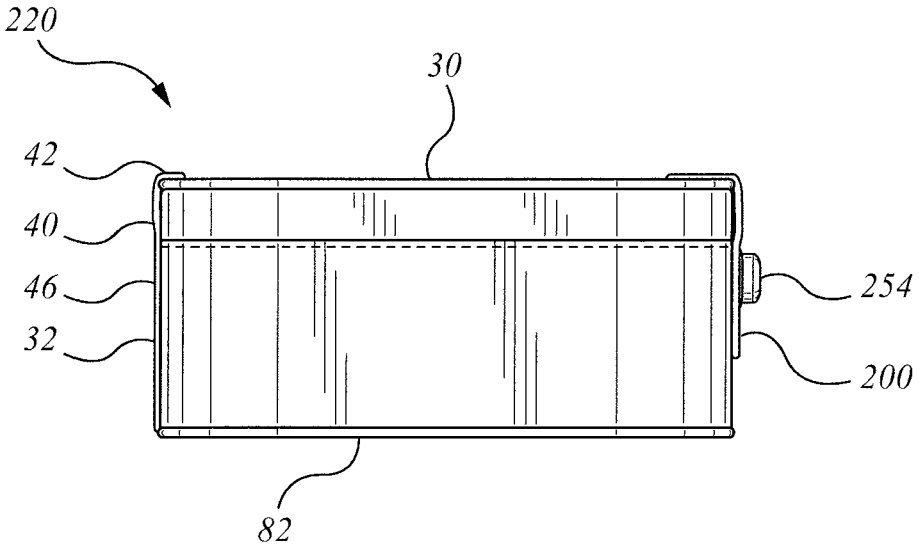
FIG. 2*i* shows a second, opposite short-end view to that of FIG. 2*h;*
Figure 3A:
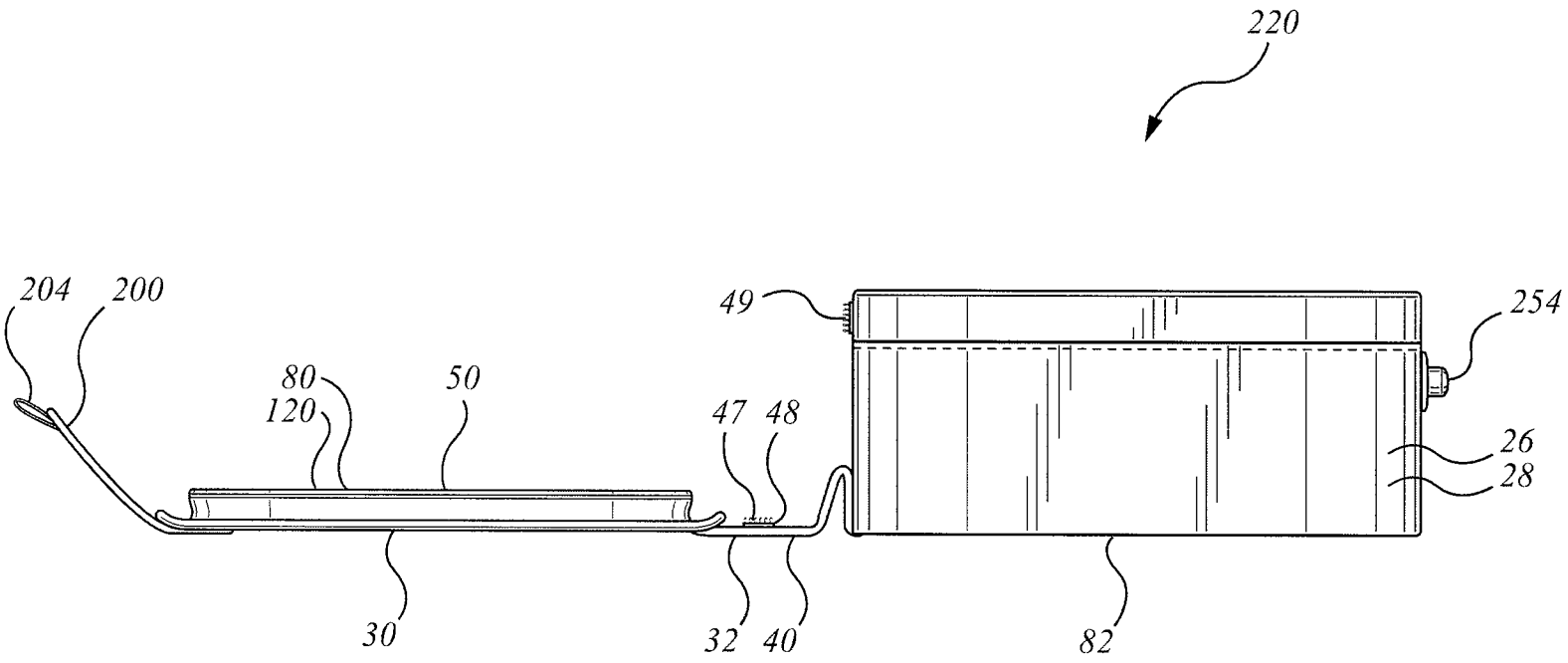
FIG. 3*a* shows an end view of the assembly of FIG. 2*a* in an open position.
Figure 3B:
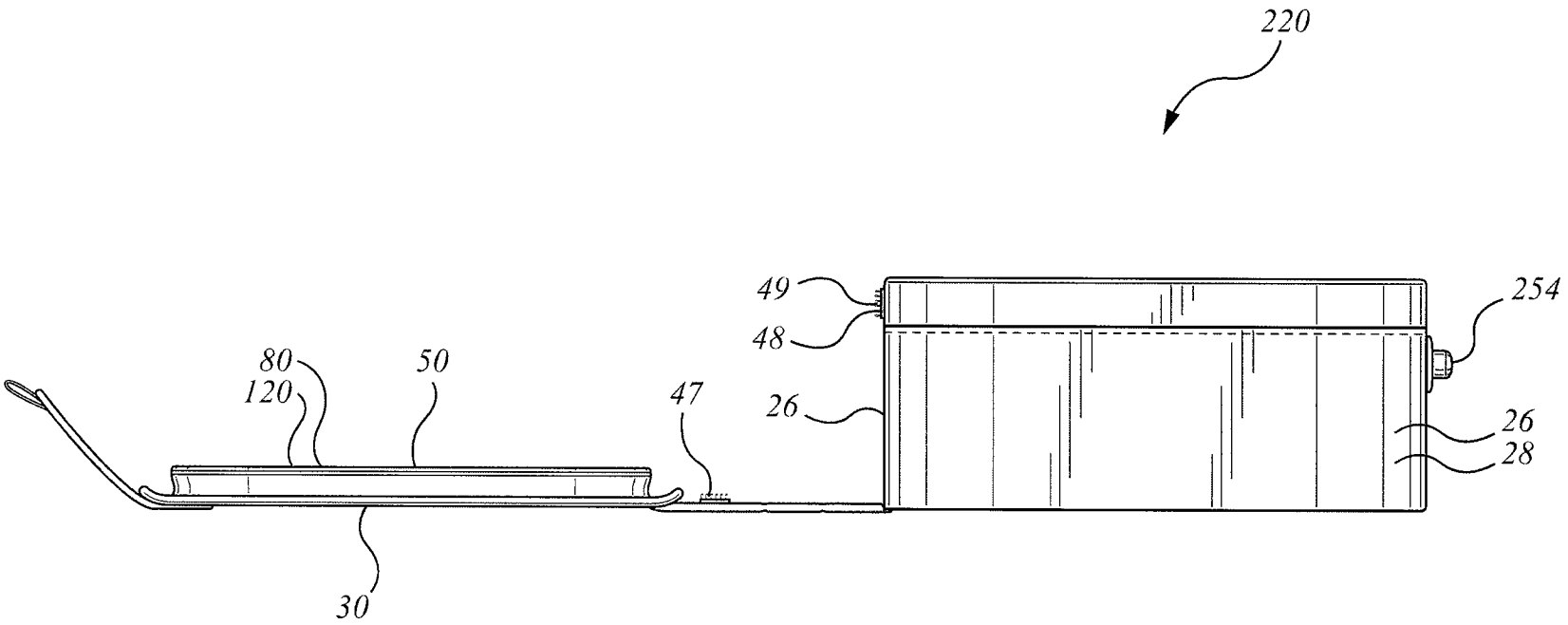
FIG. 3*b* shows an end view of the assembly of FIG. 3*a* in an alternate open position.
Figure 4A:
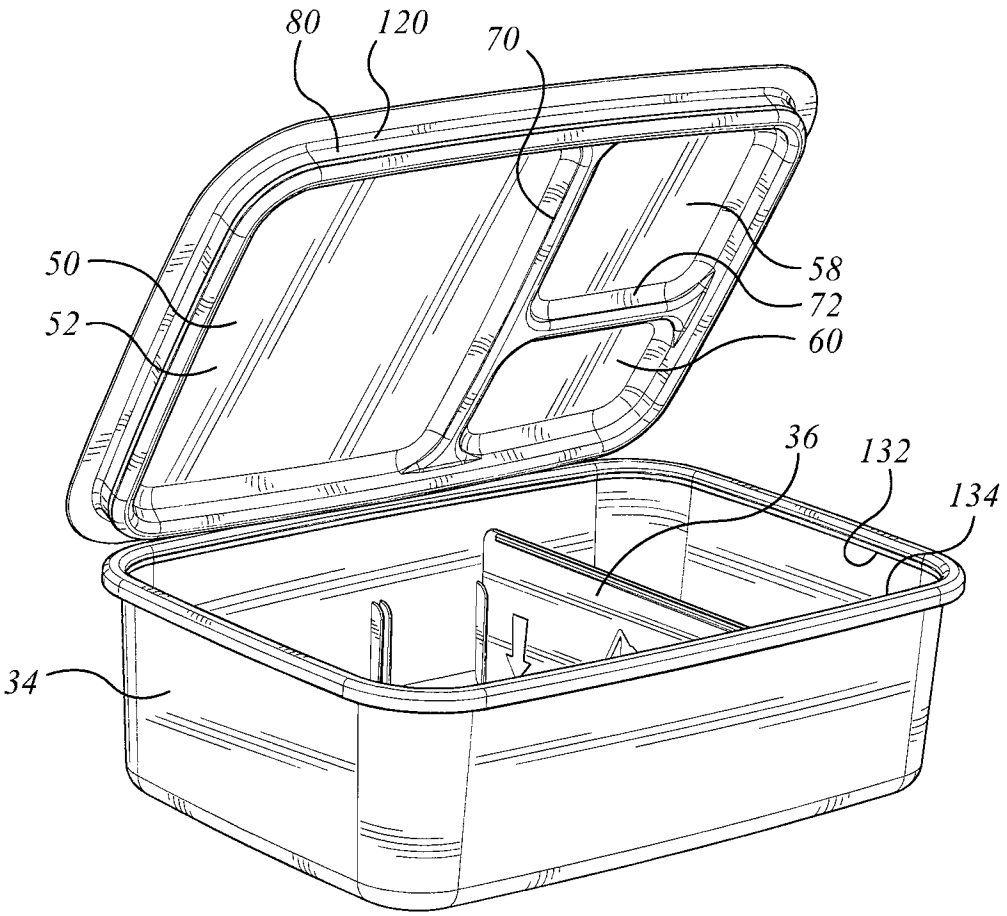
FIG. 4*a* is a perspective view of the internal liner of the assembly of FIG. 2*a;*
Figure 4B:
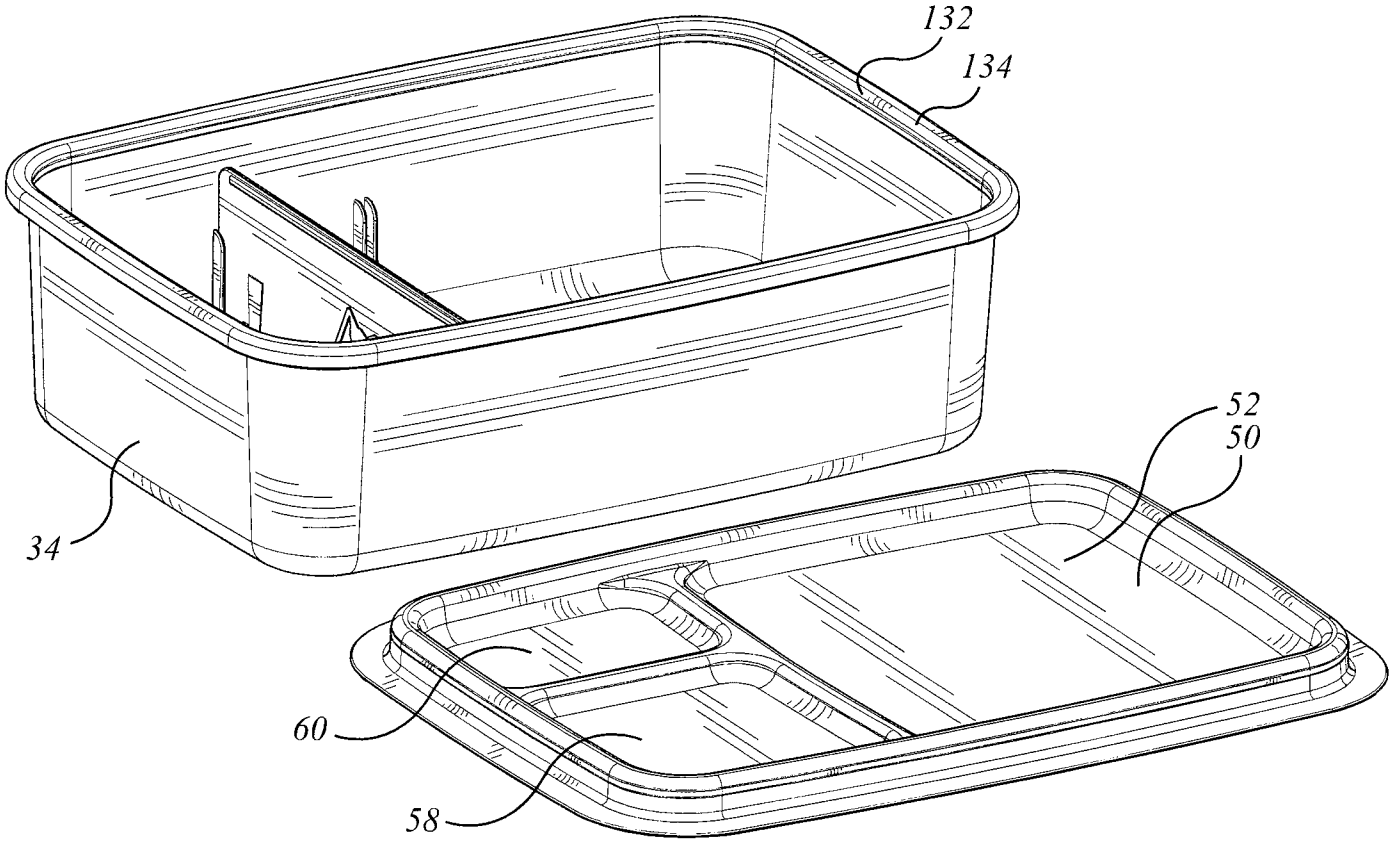
FIG. 4*b* is another perspective view of the internal liner of the assembly of FIG. 2*a;*

A lid release member or tongue, or tab 250 also includes an aperture, or seat, or socket or indexing member, or keyway 252 extending therethrough. A mating indexing member or latch, or key 254 and base 256 are mounted on front long sidewall portion 90. Key 254 may be rotatably moved between an unlocked position (as shown in FIGS. 2*c* and 2*f*) and a locked position (as shown in FIGS. 2*d* and 2*e*).

As described above, in one embodiment there is a soft-sided insulated box-shaped lunch container having an attached lid movable to an open position lying flat next thereto.

In that embodiment, the lid has an inside surface that faces upward when the lid is in the open position. The inside surface is formed to define a work surface having an object retainer. The lid includes a stiffened member formed to define the work surface. The object retainer includes a raised relief feature formed in the stiffened member. The stiffened member formed has a work surface and a raised retaining rim. The stiffened member has a plurality of sub-regions of the stiffened member having raised retainers.

In the embodiments shown and described, the container has a length and a width, and a through thickness. The through thickness is less than each of the length and the width. The container has a main body having a base and an upstanding peripheral side wall. The main body has a peripheral margin to which the lid mates in a closed position. In the open position the lid lies at a level shy of the margin, namely adjacent to the base. The lid is secured to the body by a flexible securement in the form of a flexible hinge running along a margin of the lid. The container has a depth dimension, and the hinge has a reach equal to at least half of that depth. The hinge includes a web member having a first margin joined to the lid and a second margin joined to the body adjacent to a base of the body. The web is movable to a flat position intermediate the lid and the body when the lid is in the open position. The hinge has a releaseable attachment intermediate the first margin and the lid, by which it is releasably securable to the body. The container has a body and a rigid liner mounted within the body. The lid has a formed member matable with the rigid liner in an interference fit.

In those embodiments the container has a main body having a base and an upstanding peripheral side wall. The main body has a margin distant from the base to which the lid mates in a closed position. A rigid liner is mounted within the body. The lid is joined to the body by a flexible hinge. The lid has a rigid formed member that includes a first region defining a first work surface. The first work surface faces upwardly when the lid is in the open position. The rigid formed member has at least a first raised retainer formed therein about at least a first region of the first work surface. The rigid formed member of the lid is matingly engageable with the rigid liner in an interference fit when the lid is in a closed position.

The top wall is movable between an open position and a closed position. In the closed position, the top wall, the bottom wall and the peripheral wall define an inner volume in which to receive objects. In the open position, the flexible attachment member extends away from the soft-sided insulated wall structure and allows the bottom wall and the outer surface of the top wall to lie flat generally beside each other such that the substantially rigid inner member of the top wall defines a work surface.

The container has a substantially rigid liner that fits closely within the soft-sided insulated wall structure to occupy substantially all of the inner volume. The substantially rigid liner has a mouth that includes a peripherally extending rim defining a land. The substantially rigid inner member of the top wall includes a peripherally extending engagement member that includes a stiffened member. The stiffened member is operable on closing of the top wall to engage the land of the substantially rigid liner. The cooperable peripherally extending engagement member of the top wall and the land of the substantially rigid liner define a closure of the assembly, the closure so defined are zipperless. The substantially rigid inner member of the top wall includes a raised member extending out-of-plane relative to the substantially planar lid. The raised member sub-divides the working surface into sub-sections.

In some embodiments, the top wall has a tab extending outwardly from a second edge portion thereof, the second edge portion are opposite the first edge portion. The extending tab has a keyway extending therethrough and a releasable tab fastener on an underside thereof, the keyway adjacent to the releasable tab fastener. The peripheral wall has a tab securement fitting mounted thereon for matingly engaging the releasable tab fastener and a key adjacent to the tab securement fitting, the key are movable between a locked position and an unlocked position. In the closed position of the top wall, the releasable tab fastener is aligned with the tab securement fitting and the key is aligned with the keyway of the extending tab. When the key is in the unlocked position the key passes through the keyway and the releasable tab fastener is matingly engaged with the tab securement fitting, and when the key is in the locked position the key is unable to pass through the keyway.

Although the various embodiments have been illustrated and described herein, the principles of the present invention are not limited to these specific examples which are given by way of illustration.

I claim:

1. A soft-sided insulated box-shaped lunch container having a main body and an attached lid movable to an open position lying flat next to said main body;

said main body of said container has a length, a width, and a through thickness, said through thickness being, less than each of said length and said width;

said main body has a base and an upstanding peripheral side wall;

said peripheral side wall of said main body has a peripheral margin to which said lid mates in a closed position; and in said open position said lid lies at a level shy of said peripheral margin of said main body.

2. The soft-sided insulated box-shaped lunch container of claim 1 wherein said lid has an inside surface that faces upward when said lid is in said open position, said inside surface being formed to define a work surface having an object retainer.

3. The soft-sided insulated box-shaped container of claim 2 wherein said lid includes a stiffened member, said stiffened member being formed to define said work surface.

4. The soft-sided insulated box-shaped lunch container of claim 3 wherein said object retainer includes a raised relief feature formed in said stiffened member.

5. The soft-sided insulated box-shaped lunch container of claim 2 wherein said lid includes a stiffened member, said stiffened member being formed to define a work surface and a raised retaining rim of said work surface, said upwardly facing inside surface of said lid including said work surface.

6. The soft-sided insulated box-shaped lunch container of claim 5 wherein said stiffened member of said lid has a plurality of sub-regions of said stiffened member having raised retainers, said sub-regions being defined on an inside of said lid, whereby, when said lid is open and lying flat on the ground next to said body, said sub-regions face upward.

7. The soft-sided insulated box-shaped lunch container of claim 1 wherein:

said base is substantially rectangular;

said peripheral wall has four side portions corresponding to four sides of said substantially rectangular base;

said peripheral wall has a depth measured from said base wall to said lid;

said lid is joined to said body by a flexible hinge;

said flexible hinge has a first edge connected to a margin of said lid;

said flexible hinge has a second edge mated to said body distant from said rim of said peripheral wall;

said hinge has a reach measured between said first and second edges thereof, said reach being at least half as great as said through thickness of said main body; and in said open position said lid lies adjacent to said base wall.

8. The soft-sided insulated box-shaped lunch container of claim 1 wherein said lid is secured to said body by a flexible securement.

9. The soft-sided insulated box-shaped lunch container of claim 8 wherein said flexible securement is a flexible hinge running along a margin of said lid.

10. The soft-sided insulated box-shaped lunch container of claim 9 wherein said hinge has a reach equal to at least half of said through thickness of said main body of said container.

11. The soft-sided insulated box-shaped container of claim 10 wherein said hinge has a reach corresponding to said through thickness of said main body of said container, and said hinge includes a web member having a first margin joined to said lid and a second margin joined to said body adjacent to a base of said main body, said web being movable to a flat position intermediate said lid and said main body when said lid is in said open position.

12. A soft-sided insulated box-shaped lunch container having a main body and an attached lid movable to an open position lying flat next to said main body; said container having a body, said lid being secured to said body by a flexible securement; said flexible securement being a flexible hinge running along a margin of said lid; and said hinge being joined to said body along a first margin, and having a releaseable attachment by which said hinge is releasably securable to said body, said releasable attachment being intermediate said first margin and said lid.

13. The soft-sided insulated box-shaped container of claim 1 wherein said container has a rigid liner mounted within said main body, said lid having a formed member matable with said rigid liner in an interference fit.

14. A soft-sided insulated box-shaped lunch container having:

a main body and an attached lid movable to an open position lying flat next to said main body;

said container has a length and a width, and a through thickness, said through thickness being less than each of said length and said width;

said main body having a base and an upstanding peripheral side wall;

said main body having a margin distant from said base to which said lid mates in a closed position;

a rigid liner is mounted within said main body;

said lid is joined to said main body by a flexible hinge, said flexible hinge having a first connection along a margin of said lid and a second connection along said main body, said hinge having a reach at least half as great as said through thickness of said main body;

said lid having a rigid formed member;

said rigid formed member including a first region defining a first work surface, said first work surface facing upwardly when said lid is in said open position;

said rigid formed member having at least a first raised retainer formed therein about at least a first region of said first work surface; and said second connection of said hinge is along a margin of said base, and said hinge has a releasable securement intermediate said first connection and said second connection.

15. The soft-sided insulated box-shaped lunch container of claim 1 wherein:

said soft-sided insulated wall structure includes a top wall;

said top wall is joined to said main body by a flexible hinge;

said flexible hinge has a first end and a second end distant from said first end;

said first end is distant from said second end by a distance that is at least half as great as said through thickness of said container;

said first end of said flexible hinge has a first connection to a margin of said top wall; and said second end of said flexible hinge has a connection along said body distant from said top wall.

16. A container assembly that includes a soft-sided insulated wall structure and a flexible attachment member, wherein:

said soft-sided insulated wall structure includes a top wall, a bottom wall and a peripheral wall running about said bottom wall;

said peripheral wall extends upwardly away from said bottom wall and has an upper margin distant from said bottom wall;

said flexible attachment member has a first end and a second end, said first end fixed to an attachment portion of said insulated wall structure;

said top wall is connected to said second end of said flexible attachment member;

said top wall includes an outer surface and a substantially rigid inner member;

said top wall is movable between an open position and a closed position;

in said closed position, said top wall, said bottom wall and said peripheral wall define an inner volume in which to receive objects; and in said open position, said flexible attachment member extends away from said peripheral wall of said soft-sided insulated wall structure and allows said bottom wall and said outer surface of said top wall to concurrently lie flat such that said substantially rigid inner member of said top wall defines a work surface on which to place objects.

17. The container assembly of claim 16 further comprising:

a substantially rigid liner, said substantially rigid liner being sized to fit closely within said soft-sided insulated wall structure such that said substantially rigid liner occupies substantially all of said inner volume;

said substantially rigid liner has a mouth that includes a peripherally extending rim defining a land; and said substantially rigid inner member of said top wall includes a peripherally extending engagement member that includes a stiffened member, said stiffened member being operable on closing of said top wall to engage said land of said substantially rigid liner;

when said top wall engages said land on closing, said flexible attachment member being located outside and next to said peripheral wall; and said co-operable peripherally extending engagement member of said top wall and said land of said substantially rigid liner define a closure of said assembly, said closure so defined being zipperless.

18. The container assembly of claim 16 wherein:

said top wall is a substantially planar lid of said assembly; and said substantially rigid inner member of said top wall includes a raised member extending out-of-plane relative to said substantially planar lid, said raised member sub-dividing said working surface into sub-sections.

19. A container assembly that includes a soft-sided insulated container and a substantially rigid liner, wherein:

said container has a soft-sided wall structure having a top wall, a bottom wall, left and right hand short sidewall portions, first and second long sidewall portions, and a flexible attachment member;

said bottom wall is substantially rectangular;

said bottom wall has first and second short side edges, and first and second long side edges;

said first and second long sidewall portions adjoin said first and second long side edges and extend upwardly away from said bottom wall;

said left and right hand short sidewall portions adjoin said first and second short side edges and extend upwardly away from said bottom wall;

said first and second long side wall portions and said left and right hand short side wall portions co-operate to define a peripheral wall running about said bottom wall;

said flexible attachment member having a first end and a second end, said first end fixed to a portion of said bottom wall;

said top wall is generally rectangular;

said top wall has an edge portion connected to the second end of said flexible attachment member;

said top wall is movable between an open position and a closed position;

in said closed position said bottom wall, top wall, left and right hand short sidewall portions, and first and second long sidewall portions define an internal volume therewithin;

said substantially rigid liner is sized to fit closely within said soft-sided wall structure such that said substantially rigid liner occupies substantially all of said internal volume;

said substantially rigid liner has a mouth that includes a peripherally extending rim defining a land;

said top wall includes an outer surface and a substantially rigid inner member, said substantially rigid inner member including a peripherally extending engagement member that includes a stiffened member, said stiffened member being operable on closing of said top wall to engage said land of said substantially rigid liner;

in said open position, said flexible attachment member allowing said outer surface of said top wall and said bottom wall to concurrently lie flat such that said substantially rigid inner member of said top wall defines a work surface on which to place objects;

said co-operable peripherally extending engagement member of said top wall and said land of said substantially rigid liner define a closure of said assembly, said closure so defined being zipperless, said bottom wall, left and right hand short sidewall portions, and said first and second long sidewall portions, define a main body of said container;

said top wall defines a lid of said container;

said left and right hand short sidewall portions, and said first and second long sidewall portions co-operate to define a peripheral wall of said container;

said main body of said container has a length, a width, and a through thickness, said through thickness being less than each of said length and said width;

said main body has a base and an upstanding peripheral side wall;

said peripheral sidewall wall of said main body has a peripheral margin to which said lid mates in a closed position; and in said open position said lid lies at a level shy of said peripheral margin of said main body.

* * * * *